US006120143A

United States Patent [19]

Narushima et al.

[11] Patent Number: 6,120,143

[45] Date of Patent: Sep. 19, 2000

[54] APPARATUS FOR HOLDING A PRINTING MEDIUM ON A ROTARY DRUM AND INK JET PRINTER USING THE SAME

[75] Inventors: Tsugio Narushima, Mishima; Tadao Kamano; Takuro Ito, both of Shizuoka-ken; Mitsuo Kubo, Yokohama; Hiroyuki Takada; Yasuhiro Suzuki, both of Shizuoka-ken; Takashi Kashiwagi, Mishima; Sakae Shiida, Numazu; Shinichiro Fujii, Mishima, all of Japan

[73] Assignee: Toshiba Tec Kabushiki Kaisha, Tokyo, Japan

[21] Appl. No.: 08/966,911

[22] Filed: Nov. 6, 1997

[30] Foreign Application Priority Data

| | | | |
|---|---|---|---|
| Nov. 8, 1996 | [JP] | Japan | 8-296958 |
| Nov. 11, 1996 | [JP] | Japan | 8-298367 |
| Nov. 28, 1996 | [JP] | Japan | 8-317330 |
| Jan. 22, 1997 | [JP] | Japan | 9-009717 |
| Mar. 13, 1997 | [JP] | Japan | 9-058849 |
| Mar. 28, 1997 | [JP] | Japan | 9-076840 |

[51] Int. Cl.[7] ..... B41J 2/01; G03G 15/01

[52] U.S. Cl. ..... 347/104; 346/138; 399/304

[58] Field of Search ..... 347/42, 104; 346/138; 399/303–305; 400/56; 101/415.1

[56] References Cited

U.S. PATENT DOCUMENTS

| | | | |
|---|---|---|---|
| 4,401,991 | 8/1983 | Martin | 347/41 |
| 4,914,482 | 4/1990 | Ammenheuser et al. | 399/304 |
| 5,121,139 | 6/1992 | Burke | 346/138 |
| 5,142,305 | 8/1992 | Maslanka et al. | 346/138 |
| 5,196,869 | 3/1993 | Park | 346/138 |
| 5,241,907 | 9/1993 | Dorsam et al. | 101/415.1 |
| 5,245,358 | 9/1993 | Reeves et al. | 346/138 |
| 5,249,024 | 9/1993 | Menjo | 399/45 |
| 5,455,604 | 10/1995 | Adams et al. | 346/138 |
| 5,931,589 | 8/1999 | Kamano et al. | 347/104 X |

FOREIGN PATENT DOCUMENTS

| | | |
|---|---|---|
| 56-69171 | 6/1981 | Japan . |
| 57-174285 | 10/1982 | Japan . |
| 6-218947 | 8/1994 | Japan . |

*Primary Examiner*—William J. Royer

*Attorney, Agent, or Firm*—Frishauf, Holtz, Goodman, Langer & Chick, P.C.

[57] ABSTRACT

An apparatus for holding a printing medium on a rotary drum, includes a rotary drum, a suction device, a medium holding mechanism and a medium removing device. The drum has a recess at its outer surface to extend along its rotation center line and rotates at a predetermined speed. A region of the outer surface, which is adjacent to a rearward end of the recess along the rotation direction, is smaller in the diameter than the remaining of the outer surface. The suction device holds by suction the medium onto the outer surface. The holding mechanism has a hook in the recess and selectively drives the hook between close and open positions. At the close position, the hook is placed over the adjacent region while being prevented from radially outwardly projecting from the remaining of the outer surface, and at the open position it is distanced from the adjacent region. When the medium arrives at the adjacent region, its leading end is held by the hook shifted from the open position to the close position and cooperated with the adjacent region and, when the drum rotates a specific number, the hook is returned to the open position. The removing device removes the medium from the outer surface when the drum rotates the specific number and the hook has moved from the close position to the open position.

41 Claims, 15 Drawing Sheets

APPARATUS FOR HOLDING A PRINTING MEDIUM ON A ROTARY DRUM AND INK JET PRINTER USING THE SAME

BACKGROUND OF THE INVENTION

The present invention relates to an apparatus for holding a printing medium on a rotary drum and an ink jet printer using the same.

As personal computers have widely been marketed, their associated color printers are demanded for commercial use. Such conventional color printers are classified into serial, parallel, and line types depending on the mode of printing equipment.

A color printer provided with serial printing equipment includes a printing head having a plurality of ink jet nozzles for ejection of different colors (namely, yellow, magenta, cyan, and black). A conventional color printer provided with the serial printing equipment permits a printing medium such as a sheet of paper of a given size to be conveyed at equal intervals of a pitch in a predetermined direction. During the conveying, the printing head performs reciprocating motions over a surface of the printing medium at a right angle to the conveying direction of the printing medium. The printing head while traveling over the printing medium applies jets of specific inks to the surface of the printing medium at a given location in the reciprocating motion. As the printing head repeats application of the inks to the surface of the printing medium along the conveying direction, a desired image of the inks (which may include characters, numerals, symbols, etc.) is printed in a given area on the surface of the printing medium. The construction of such a conventional color printer provided with the serial printing equipment is well known. The conventional color printer has a printing head which can easily be fabricated and its overall arrangement is relatively simple, thus minimizing the size and lowering the cost. However, the conventional color printer has some disadvantages that the printing head is slow in the speed of printing action and produces a considerable degree of noise, hence being hardly suited for business use which requires production of a large number of prints in a shorter duration of time with less sounds.

A conventional color printer provided with parallel printing equipment allows a printing medium such as a sheet of paper of a given size to be conveyed at a specific speed in a predetermined direction under a plurality of printing units which are arranged at intervals of a given distance along the conveying direction. The printing units are parallel to each other extending at a right angle to the conveying direction between both sides of the printing medium. While the printing medium is conveyed at the specific speed in the conveying direction, different colors (namely, yellow, magenta, cyan, and black) are applied by their respective printing units to print an image on the printing medium. Each of the printing units comprises a photosensitive drum and a static charger, an exposer, a toner developer, a transfer device, a cleaner, and a discharger mounted about the photosensitive drum. The printing unit of this arrangement is known as used in a plain paper copier (PPC). The conventional color printer is quiet during the printing action and higher in printing speed thus producing a large number of prints within a shorter period of time and can thus be suited for business use. However, the conventional color printer provided with the parallel printing equipment includes two or more of the printing units which are expensive and its construction is not simple, thus increasing the cost of production as well as the overall size.

A color printer provided with line type printing equipment also permits a printing medium such as a sheet of paper of a given size to be conveyed at a specific speed in a predetermined direction under a plurality of printing heads which are arranged at intervals of a given distance along the conveying direction. The printing heads are parallel to each other extending at a right angle to the conveying direction between both sides of the printing medium. Each of the printing heads includes a plurality of ink jet nozzles for ejection of one of different color inks (namely, yellow, magenta, cyan, and black). The ink jet nozzles on the printing head are aligned in a row extending at a right angle to the conveying direction between two sides of the printing medium. While the printing medium is conveyed at the specific speed in the conveying direction, the colors are applied by their respective printing heads.

As compared with the serial printing equipment, the line type printing equipment has the following advantages and disadvantages.

The printing head in the line type printing equipment has more ink jet nozzles than that in the serial printing equipment and is thus very expensive. The line type printing equipment allows its printing heads to remain stationary to print a desired image on the printing medium which is conveyed and will thus be faster in the printing action and less noisy than the serial printing equipment.

As compared with the parallel printing equipment, the line type printing equipment has the following advantages and disadvantages.

The line type printing equipment has simpler printing heads in construction than those of the parallel printing equipment thus the overall dimensions is small and the cost of production is low. Also, the printing speed of the line type printing equipment is equal to that of the parallel printing equipment. The line type printing equipment is however lower in resolution of prints on the printing medium than the parallel printing equipment.

Recently, for minimizing the overall size without sacrificing the printing speed, the color printer provided with the line type printing equipment is equipped with an improved device for conveying the printing medium.

Any conventional color printer including the line type printing equipment which are more expensive than that with the serial printing equipment but less expensive than that with the parallel printing equipment is equal in printing speed, smaller in overall size, and slightly lower in resolution of prints than that with the parallel printing equipment, and therefore, it is now common for both business and personal uses.

For minimizing the overall size of a conventional color printer provided with the line type printing equipment without decreasing the printing speed, Jpn. Pat. Appln. KOKAI Publication No. 57-174285 and Jpn. Pat. Appln. KOKAI Publication No. 6-218947 disclose a device for conveying the printing medium that includes a rotary drum having an outer surface thereof facing a plurality of printing heads of the line type printing equipment and a printing medium holding device for detachably holding the printing medium to the outer surface of the rotary drum with certainty. In action, while the rotary drum is rotated a number of times with the printing medium detachably held to its outer surface by the printing medium holding device, the printing heads print down a desired image of different color inks on the printing medium.

However, the printing medium holding device of the prior art has a printing medium holding finger or hook which is constantly projected from the outer surface of the rotary drum for securely holding and releasing the printing medium. The printing medium holding hook however prevents the rotary drum from increasing the speed of rotation or printing action and may also disturb the action of the printing heads over the outer surface of the rotary drum thus discouraging improvement of the resolution of images printed on the printing medium.

BRIEF SUMMARY OF THE INVENTION

An object of the present invention is to provide an apparatus for holding a printing medium to a rotary drum and an ink jet printer using the same. In the apparatus, the printing speed is increased and the printing medium is securely held with much ease so that the quality of a printed image and the re solution are improved.

For achievement of the above object of the present invention, an apparatus for holding a printing medium to a rotary drum comprises: a rotary drum having a center line of rotation thereof, an outer surface arranged substantially concentric with the center line of rotation, and a recess provided in the outer surface to extend along the center line of rotation, and driven for rotation about the center line of rotation at a predetermined speed, in which a region of the outer surface of the rotary drum, which is adjacent to a rearward end of the recess along the direction of rotation, is smaller in diameter than the remaining of the outer surface; a printing medium suction device mounted to the rotary drum and holding by suction the printing medium fed from the outside onto the outer surface of the rotary drum; a printing medium holding mechanism having a printing medium holding hook located in the recess and mounted to the rotary drum for selectively driving the printing medium holding hook between the close position, where the printing medium holding hook is placed over the recess rearward end adjacent region of the outer surface while being prevented from radially outwardly projecting from the remaining of the outer surface, and the open position which is distanced from the recess rearward end adjacent region of the outer surface, in which when the printing medium arrives at the recess rearward end adjacent region of the outer surface of the rotary drum, its leading end is held by the printing medium holding hook shifted from the open position to the close position and cooperated with the recess rearward end adjacent region of the outer surface and when the rotary drum has conducted a specific number of rotations, the printing medium holding hook for holding the leading end of the printing medium is returned from the close position to the open position; and a printing medium removing mechanism removing the printing medium from the outer surface of the rotary drum when the rotary drum has conducted the specific number of rotations and the printing medium holding hook of the printing medium holding mechanism has moved from the close position to the open position.

In the apparatus for holding a printing medium to a rotary drum according to the present invention, the printing medium holding hook is accommodated in the recess provided in the outer surface of the rotary drum and its portion facing the rearward end of the recess along the direction of rotation of the rotary drum is smaller in diameter than the outer surface of the rotary drum. When the printing medium holding hook is located at the close position over the rearward end of the recess in the outer surface, it is prevented from projecting radially outwardly from the outer surface of the rotary drum.

This contributes to the increase of the printing speed and the improvement of the quality of printed images on the printing medium with much ease, hence enhancing the resolution of the printed images.

For achievement of the above object of the present invention, another apparatus for holding a printing medium to a rotary drum comprises: a rotary drum having a center line of rotation thereof and an outer surface arranged substantially concentric with the center line of rotation for rotation at a predetermined speed about the center line of rotation; a printing medium suction device mounted to the rotary drum and holding by suction the printing medium fed from the outside onto the outer surface of the rotary drum; a printing medium holding mechanism having a printing medium holding hook located on the outer surface and mounted to the rotary drum for selectively driving the printing medium holding hook between the close position, where the printing medium holding hook is placed over the outer surface, and the open position where the printing medium holding hook is spaced away from the outer surface, in which when the leading end of the printing medium arrives at the close position where the printing medium holding hook is placed over the outer surface of the rotary drum, it is held between the printing medium holding hook shifted from the open position to the close position and the outer surface of the rotary drum and when the rotary drum has conducted a specific number of rotations, the printing medium holding hook for holding the leading end of the printing medium with the outer surface of the rotary drum is returned from the close position to the open position; and a printing medium removing device removing the printing medium from the outer surface of the rotary drum when the rotary drum has conducted the specific number of rotations, said printing medium holding mechanism comprising: a hook holding member having an urging member as well as the printing medium holding hook and mounted to at least one of the two sides of the rotary drum for urging the printing medium holding hook to the close position by the force of the urging member; a hook holding member operating device provided on the side of at least one of the two sides of the rotary drum and driving the hook holding member to resist against the force of the urging member in order to shift the printing medium holding hook from the close position to the open position just before the leading end of the printing medium loaded to the outer surface of the rotary drum by the printing medium feeding device is held between the printing medium holding hook of the printing medium holding device and the outer surface of the rotary drum and before the printing medium is removed by the printing medium removing device from the outer surface of the rotary drum when the rotary drum with the printing medium loaded thereon has conducted the number of rotation; an open position lock mechanism mounted to at least one of the two sides of the rotary drum and locking the hook holding mechanism while resisting against the force of the urging member when the printing medium holding hook has been moved to the open position; and a lock release mechanism having an actuator which is actuated when the printing medium holding mechanism is located at the open position and the leading end of the printing medium loaded by the printing medium feeding device arrives at a zone of the outer surface of the rotary drum over which the printing medium holding hook is placed when it is at the close position, in which the locking of the hook holding member with the open position lock mechanism is released by the actuator.

In the another apparatus for holding a printing medium to a rotary drum according to the present invention, the printing medium holding device for selectively holding the printing medium to the outer surface of the rotary drum with the printing medium holding hook has the hook holding member driven selectively by the hook holding member operating device for movement between the open position and the close position. The hook holding member is locked at the open position by the open position lock mechanism and unlocked by the lock release mechanism when it is moved from the open position to the close position.

This also contributes to the increase of the printing speed and the improvement of the quality of printed images on the printing medium with much ease, hence enhancing the resolution of the printed images.

For achievement of the above object of the present invention, a further apparatus for holding a printing medium to a rotary drum comprises: a rotary drum having a center line of rotation thereof and an outer surface arranged substantially concentric with the center line of rotation for rotation at a predetermined speed about the center line of rotation; a printing medium suction device mounted to the rotary drum and holding by suction the printing medium fed from the outside onto the outer surface of the rotary drum; a printing medium holding mechanism having a printing medium holding hook and mounted to the rotary drum for selectively driving the printing medium holding hook between the close position, where the printing medium holding hook is placed over the outer surface, and the open position where the printing medium holding hook is spaced away from the outer surface, in which the printing medium holding hook is moved from the open position to the close position to securely hold the leading end of the printing medium loaded from the outside, with the outer surface of the rotary drum and, when the rotary drum has conducted the number of rotations, returned from the close position to the open position; and a printing medium removing device removing the printing medium from the outer surface of the rotary drum when the rotary drum has conducted the specific number of rotations and the printing medium holding hook of the printing medium holding mechanism has been moved from the close position to the open position, said printing medium holding mechanism including: a swing member mounted to at least one of the two sides of the rotary drum for pivotal movements to drive the printing medium holding hook between the close position and the open position; an open position projecting mechanism mounted between the printing medium holding hook and the swing member and allowing the printing medium holding hook at the open position to hold its rearward end, which is located opposite to the direction of rotation, radially more outwardly than its forward end defined along the direction of rotation; an urging member mounted to one of the two sides of the rotary drum for urging the swing member to hold the printing medium holding hook to the close position; a swing member holding device mounted to at least one of the two sides of the rotary drum and selectively holding the swing member while resisting against the force of the urging member; and a printing medium holding hook operating device provided on the side of at least one of the two sides of the rotary drum and, when the swing member is not locked by the swing member holding device, driving the swing member to resist against the force of the urging member for shifting via an intermediate member the printing medium holding hook between the close position and the open position and simultaneously, to lock the swing member with the swing member holding device and, when the swing member is locked by the swing member holding device, driving the swing member holding device to unlock the swing member and allowing the urging member to turn the swing member in the other direction for shifting via the intermediate member the printing medium holding hook between the close position and the open position, just before the leading end of the printing medium loaded to the outer surface of the rotary drum is held between the printing medium holding hook of the printing medium holding mechanism and the outer surface of the rotary drum and before the printing medium is removed by the printing medium removing device from the outer surface of the rotary drum when the rotary drum with the printing medium loaded thereon has conducted the number of rotation.

In the further apparatus, the printing medium holding device for selectively holding the printing medium to the outer surface of the rotary drum with the printing medium holding hook has the release projection mechanism for allowing the printing medium holding hook at the open position to project its rearward end, which is situated opposite to the direction of rotation, more outwardly than its forward end defined along the direction of rotation of the rotary drum.

This contributes to the increase of the printing speed and the improvement of the quality of printed images on the printing medium with much ease, hence enhancing the resolution of the printed images.

For achievement of the above object of the present invention, a still further apparatus for holding a printing medium to a rotary drum comprises: a rotary drum having a center line of rotation thereof and an outer surface arranged substantially concentric with the center line of rotation for rotation at a predetermined speed about the center line of rotation; a printing medium suction device mounted to the rotary drum and holding by suction the printing medium fed from the outside onto the outer surface of the rotary drum; a printing medium holding mechanism having a printing medium holding hook and mounted to the rotary drum for selectively driving the printing medium holding hook between the close position, where the printing medium holding hook is placed over the outer surface, and the open position where the printing medium holding hook is spaced away from the outer surface, in which the printing medium holding hook is moved from the open position to the close position to securely hold the leading end of the printing medium loaded from the outside, with the outer surface of the rotary drum and, when the rotary drum has conducted the number of rotations, returned from the close position to the open position; and a printing medium removing device removing the printing medium from the outer surface of the rotary drum when the rotary drum has conducted the specific number of rotations and the printing medium holding hook of the printing medium holding mechanism has been moved from the close position to the open position, said printing medium holding mechanism including: a swing member mounted to at least one of the two sides of the rotary drum; an intermediate member pivotably mounted to the swing member and pivotably joined to the printing medium holding hook at a location which is radially more outward from the rotary drum than the location where the swing member is joined thus allowing the printing medium holding hook to be moved between the close position and the open position by the pivotal movement of the swing member; an open position projecting mechanism mounted between the printing medium holding hook and the intermediate member and allowing the printing medium holding hook at the open position to hold its rearward end, which is located opposite to the direction of rotation, radially more outwardly than its forward end defined along the direction of rotation; an urging member mounted to one of the two sides of the rotary drum and urging the swing member in one direction; a swing member holding device mounted to at least one of the two sides of the rotary drum and selectively holding the swing member while resisting against the force of the urging member; and a printing medium holding hook operating device provided on the side of at least one of the two sides of the rotary drum and, when the swing member is not locked by the swing member holding device, driving the swing member to resist against the force of the urging member for shifting via the intermediate member the printing medium holding hook between the close position and the open position and simultaneously, to lock the swing member with the swing member holding device and, when the swing member is locked by the swing member holding device, driving the swing member holding device to unlock the swing member and allowing the urging member to turn the swing member in the other direction for shifting via the intermediate member the printing medium holding hook between the close position and the open position, just before the leading end of the printing medium loaded to the outer surface of the rotary drum is held between the printing medium holding hook of the printing medium holding mechanism and the outer surface of the rotary drum and before the printing medium is removed by the printing medium removing device from the outer surface of the rotary drum when the rotary drum with the printing medium loaded thereon has conducted the number of rotation.

In the still further apparatus, the printing medium holding device for selectively holding the printing medium to the outer surface of the rotary drum with the printing medium holding hook has the release projection mechanism for allowing the printing medium holding hook at the open position to project its rearward end, which is situated opposite to the direction of rotation, more outwardly than its forward end defined along the direction of rotation of the rotary drum.

This contributes to the increase of the printing speed and the improvement of the quality of printed images on the printing medium with much ease, hence enhancing the resolution of the printed images.

An ink jet printer having the foregoing components for holding the printing medium to the rotary drum, according to the present invention, comprises: a printing medium feeding device loading the printing medium onto the outer surface of the rotary drum at a speed corresponding to the circumferential speed of the rotary drum; and at least one printing head disposed along the outer surface of the rotary drum to extend in parallel to the center line of rotation and having a plurality of ink jet nozzles provided to face the outer surface of the rotary drum and align in parallel to the center line of rotation and arranged responsive to an image signal for applying jets of at least one color of ink to the printing medium to print an image of the image signal while the rotary drum conducts the number of rotations.

The ink jet printer may be modified in which a plurality of the printing heads are mounted to separate from each other along the outer surface of the rotary drum and arranged responsive to their corresponding image signals, each printing head extending in parallel to the center line of rotation and having a plurality of ink jet nozzles provided to face the outer surface of the rotary drum and align in parallel to the center line of rotation, so that the printing heads are responsive to their corresponding image signals for applying jets of different colors of ink to the printing medium to print a full color image of the image signals while the rotary drum conducts the number of rotations. The ink jet printer may further comprise a printing medium discharging device conveying the printing medium, which has been removed from the outer surface of the rotary drum, at least a speed corresponding to the circumferential speed of the rotary drum away from the rotary drum.

Further features and advantages of the present invention will be apparent from the detailed description in conjunction with the relevant drawings accompanied with this specification and the teachings of claims of the present invention and clearly understood by those skilled in the art.

Additional objects and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Preferred embodiments of the present invention and their modifications will be described in detail referring to the accompanying drawings.

Figure 1:
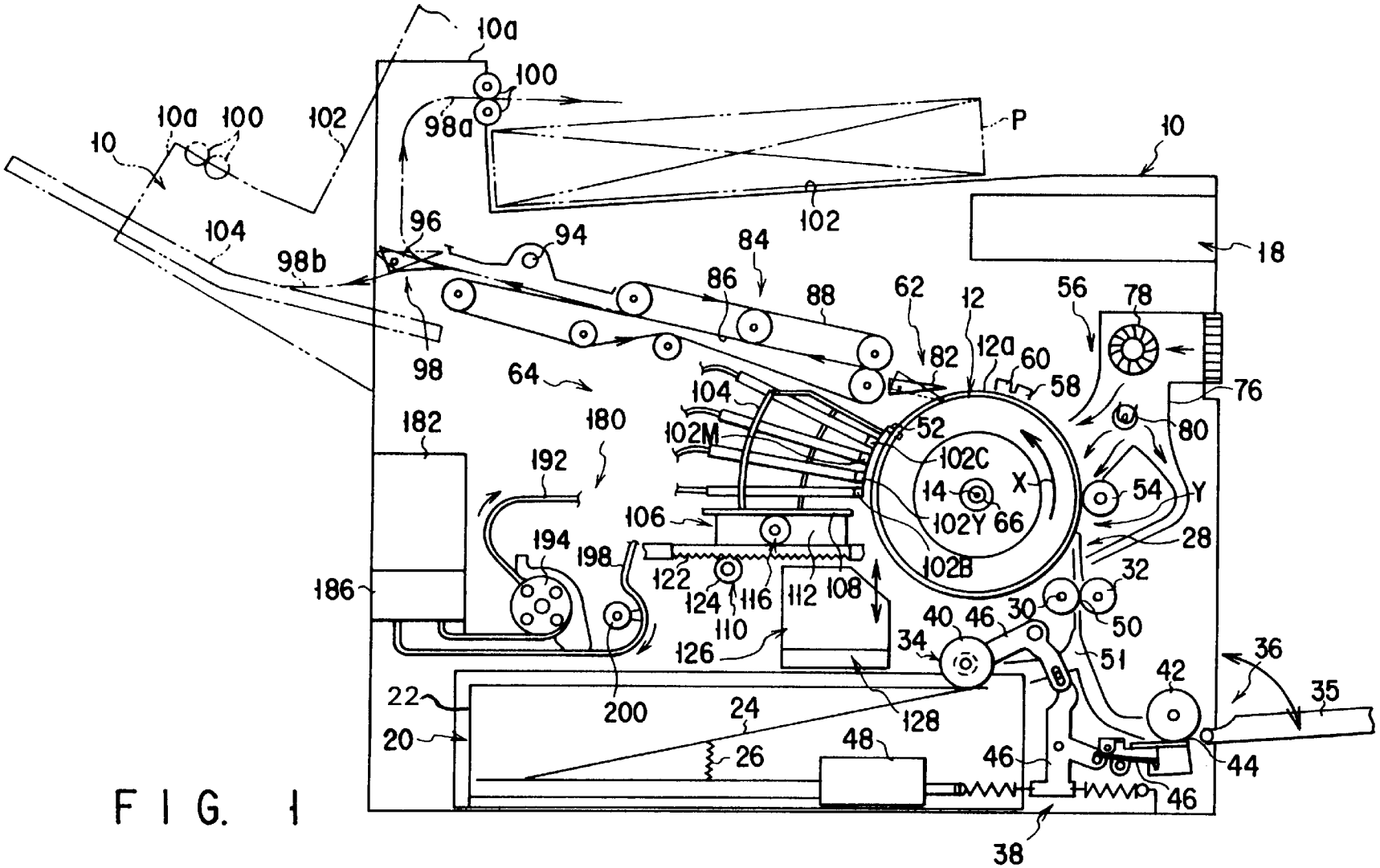
FIG. 1 is a schematic longitudinal cross sectional view of an ink jet printer provided with an apparatus for holding a printing medium on a rotary drum according to the present invention.

FIG. 1 is a longitudinal cross sectional view of a preferred embodiment of an ink jet printer provided with an apparatus for holding a printing medium on a rotary drum according to the present invention.

Referring to FIG. 1, the rotary drum 12 of the ink jet printer is rotatably supported in the inner space of a housing 10. The rotary drum 12 has an outer surface 12*a* thereof substantially disposed coaxially of the center of rotation 14 and is driven at a predetermined speed in a specific direction (namely, the counter-clockwise direction denoted by X in FIG. 1) to selectively perform a desired number of rotations by the force of rotation from a rotation power source not shown, such as a motor, under the control of a controller unit 18 mounted at an upper region of the inner space of the housing 10.

A printing medium storage device 20 is mounted beneath the rotary drum 12 in the inner space of the housing 10. The printing medium storage device 20 in the embodiment includes a cassette 22 for storage of sheets of plain paper of a desired rectangular size. The cassette 22 is detachably installed in the housing 10 for loading and unloading the paper sheets on a defined location thereof. A printing medium loading plate 24 is mounted at a defined position in the cassette 22 for lifting up and down and remains urged upwardly by an urging member 26.

A printing medium feeding device 28 is provided between the rotary drum 12 and the printing medium storage device 20 in the inner space of the housing 10, which supplies the paper sheets as the printing medium to a specific location on the outer surface 12*a* of the rotary drum 12 at a given timing controlled by the controller unit 18 to synchronize with the circumferential speed of the outer surface 12*a* of the rotary drum 12. The printing medium feeding device 28 in the embodiment comprises a pair of transfer rollers 30 and 32 located adjacent to the outer surface 12*a* of the rotary drum 12, a cassette-side printing medium feeding mechanism 34 mounted between the paired transfer rollers 30 and 32 and the cassette 22, and a tray-side printing medium feeding mechanism 36 mounted between the paired transfer rollers 30 and 32 and a manual printing medium supply tray 35 located outside the housing 10 adjacent to the cassette 22. The cassette-side printing medium feeding mechanism 34 is designed for selectively feeding the paper sheets loaded on the printing medium loading plate 24 in the cassette 22, one by one from the uppermost of their stack, to between the paired rollers 30 and 32. The tray-side printing medium feeding mechanism 36 is adapted for feeding each of the paper sheets manually loaded in the manual printing medium supply tray 35 to between the paired rollers 30 and 32.

Both the cassette-side printing medium feeding mechanism 34 and the tray-side printing medium feeding mechanism 36 are driven by a common rotating drive source (a motor) not shown and their feeding actions are switched from one to the other by an action switching mechanism 38 provided between the two mechanisms 34 and 36.

More specifically, the cassette-side printing medium feeding mechanism 34 has a pick-up roller 40 provided in direct contact with the uppermost of the stack of the paper sheets loaded on the printing medium loading plate 24 in the cassette 22. The tray-side printing medium feeding mechanism 36 has a printing medium input roller 42 located adjacent to an input opening of the housing 10 through which the printing medium is fed from the manual printing medium supply tray 35. Both the pick-up roller 40 of the cassette-side printing medium feeding mechanism 34 and the printing medium input roller 42 of the tray-side printing medium feeding mechanism 36 are connected via a known rotation transmitting mechanism such as a train of toothed wheels, not shown, to a common rotation drive source, not shown, (a bi-directional motor). When the common rotation drive source (or bi-directional motor) rotates in one direction, its rotation is transmitted to the pick-up roller 40. When the common rotation drive source rotates in the other direction, its rotation is transmitted to the printing medium input roller 42. The tray-side printing medium feeding mechanism 36 also has a friction strip 44 provided opposite to the printing medium input roller 42. The friction strip 44 of the tray-side printing medium feeding mechanism 36 is connected by a link member 46 of the action switching mechanism 38 to the pick-up roller 40 of the cassette-side printing medium feeding mechanism 34. The link member 46 is linked to a known actuator 48. When the actuator 48 is turned on and off, the link member 46 actuates the pick-up roller 40 and the friction strip 44 to move between the action position and the rest position. At the action position, the pick-up roller 40 comes into direct contact with the uppermost of the paper sheets in a stack loaded on the printing medium loading plate 24 in the cassette 22 and the friction strip 44 of the tray-side printing medium feeding mechanism 36 touches or comes close to the printing medium input roller 42. At the rest position, the pick-up roller 40 departs from the uppermost of the paper sheets loaded on the printing medium loading plate 24 in the print medium storage device or cassette 20 and the friction strip 44 is spaced from the printing medium input roller 42.

When the pick-up roller 40 is driven by the rotation of the unshown common rotation drive source (or bi-directional motor) and moved to the action position, it picks up and feeds the uppermost of the paper sheets from the printing medium loading plate 24 in the cassette 20 to between the paired transfer rollers 30 and 32. When the printing medium input roller 42 is driven by the rotation of the unshown common rotation drive source (or bi-directional motor) with the friction strip 44 moved to the action position, it feeds the printing medium manually supplied to the manual printing medium supply tray 35 between the paired transfer rollers 30 and 32.

There is a known detecting device such as an optical sensor, not shown, provided just before the contact line 50 between the paired transfer rollers 30 and 32 for detecting the leading end of the printing medium supplied from the cassette 20 or the manual printing medium supply tray 35. The distance of travel of the printing medium from the pick-up roller 40 of the cassette-side printing medium feeding mechanism 34 to the contact line 50 and the distance of travel of the printing medium from the printing medium input roller 42 of the tray-side printing medium feeding mechanism 36 to the contact line 50 both are shorter than the length of the printing medium defined in the direction of travel. When a specified length of time has passed after the detecting device detected the leading end of the printing medium, the pick-up roller 40 of the cassette-side printing medium feeding mechanism 34 and the friction strip 44 of the tray-side printing medium feeding mechanism 36 are switched from the action position to the rest position. This allows the printing medium fed from either the cassette-side printing medium feeding mechanism 34 or the tray-side printing medium feeding mechanism 36 to be unrestrained with its leading end reaching the contact line 50 in a loose space 51 defined across the path of the printing medium between the pick-up roller 40 of the cassette-side printing medium feeding mechanism 34 and the contact line 50 or between the printing medium input roller 42 of the tray-side printing medium feeding mechanism 36 and the contact line 50. As the printing medium touches the contact line 50, its skew to the contact line 50 can be corrected.

After the leading end of the printing medium is detected by the detecting device and touches the contact line 50 but before the pick-up roller 40 and the friction strip 44 are shifted to the rest position, the paired transfer rollers 30 and 32 are rotated through a predetermined angle. This rotating motion of the paired transfer rollers 30 and 32 permits the leading end of the printing medium to insert between the paired transfer rollers 30 and 32. The rotating motion is terminated by a known detecting device such as an optical sensor, not shown, which is located at the exit side of the paired transfer rollers 30 and 32, detecting the leading end of the printing medium passing the contact line 50 between the paired transfer rollers 30 and 32. Since the leading end of the printing medium is being inserted between the paired transfer rollers 30 and 32, it is prevented from returning from the contact line 50 to the cassette 20 or the manual printing medium supply tray 35 after the shifting of the pick-up roller 40 and the friction strip 44 to the rest position. Also, the shifting of the pick-up roller 40 and the friction strip 44 to the rest position avoids untimed supply of two consecutive printing mediums from the cassette 20 or the manual printing medium supply tray 35.

As the leading end of the printing medium has been inserted between the paired transfer rollers 30 and 32, it is driven at predetermined timing to a given location Y over the outer surface 12*a* of the rotary drum 12 by the paired transfer rollers 30 and 32 controlled by the controller unit 18. The speed of the printing medium by the paired transfer rollers 30 and 32 for driving the printing medium is identical to the circumferential speed at the outer surface 12*a* of the rotary drum 12.

Denoted by 52 in FIG. 1 is a known detecting device such as an optical sensor which is located close to the outer surface 12*a* of the rotary drum 12 for detecting a particular point (namely, the location of a printing medium holding finger described later) on the outer surface 12*a* of the rotary drum 12. When the detecting device 52 detects the particular point on the outer surface 12*a* of the rotary drum 12, the controller unit 18 determines a timing for starting the action of the paired transfer rollers 30 and 32 so that the leading end of the printing medium comes to the location Y in synchronism with the particular point of the outer surface 12*a* of the rotary drum 12 arriving at the point Y.

An initial charger 54, a preheating device 56, a sub-charger 58, a discharger 60, a printing medium removing device 62, and an ink using printing equipment 64 are mounted in this order from the location Y along the direction of rotation X of the rotary drum 12 about the outer surface 12*a* of the rotary drum 12.

The initial charger 54 in the embodiment comprises a charging roller for pressing the printing medium onto the rotary drum 12 and applying positive charges to the printing medium on the outer surface 12*a* of the rotary drum 12 which rotates in the direction X at the predetermined circumferential speed with the printing medium supplied and loaded by the paired transfer rollers 30 and 32 from the cassette 20 or the manual printing medium supply tray 35. When the printing medium has been moved to the location Y over the outer surface 12*a* of the rotary drum 12 by the driving action of the paired transfer rollers 30 and 32, it is held with the printing medium holding finger which is located at the particular point on the outer surface 12*a* of the rotary drum 12 as will be described later and secured by electrostatic attraction of the charges to the outer surface 12*a* of the rotary drum 12. The circumferential length of the outer surface 12*a* of the rotary drum 12 is longer than the length of the printing medium defined in the direction of travel and the width along the center line of rotation 14 is greater than the width of the printing medium. In this embodiment, the printing medium is a sheet of the A4 size, 297 mm long by 210 mm wide, defined in the Japanese Industrial Standard (JIS).

The charging roller of the initial charger 54 is pressed against the outer surface 12*a* of the rotary drum 12 until the printing medium supplied from the paired transfer rollers 30 and 32 is attached throughout its length by the suction to the outer surface 12*a* of the rotary drum 12 and can thus assist the attachment of the printing medium to the outer surface 12*a* of the rotary drum 12.

The rotary drum 12 in the embodiment is made of an aluminum alloy, has a diameter of 130 mm and a width of 220 mm at the outer surface 12*a*. Then, the circumferential length of the outer surface 12*a* of the rotary drum 12 is expressed by the diameter of the outer surface 12*a*×π=408 mm. If it is desired to have the circumferential length of the outer surface 12*a* of the rotary drum 12 increased longer than that of the A4 size, the diameter of the outer surface 12*a* of the rotary drum 12 is 100 mm or more.

Figure 2:
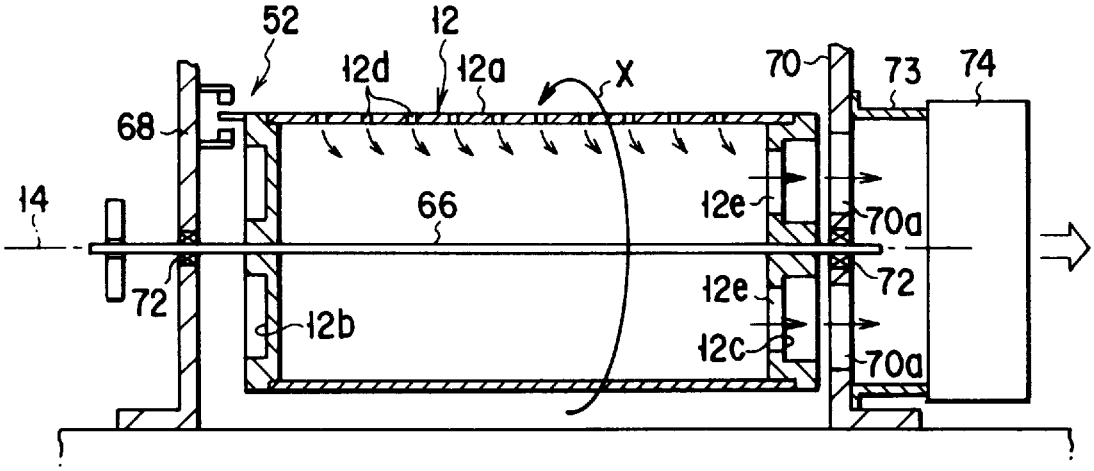
FIG. 2 is a schematic longitudinal cross sectional view showing the rotary drum with a negative pressure generator which is a member of a printing medium suction unit in the ink jet printer shown in FIG. 1.

FIG. 2 illustrates a cross section of a construction, taken along the center line of rotation 14, for supporting the rotary drum 12 in the housing 10. As shown in FIG. 2, (and also shown in FIG. 1) the rotary drum 12 has a rotation center shaft 66 extending coaxially of the center line of rotation 14. Both ends of the rotation center shaft 66 extend outwardly from two ends 12*b* and 12*c* of the rotary drum 12 and are rotatably supported by bearings 72 on support brackets 68 and 70 respectively in the housing 10. One end of the rotation center shaft 66 is connected via a known power transmission unit, not shown to a known rotation drive source such as a servo motor, not shown, which is advantageous in the response and the constant speed. The rotary drum 12 in the embodiment may be driven at a constant rate of 120 r.p.m. in the direction X of rotation by the known rotation drive source. More specifically, the rotary drum 12 rotates at a speed of 120(rpm)×π×130(diameter in mm)/60= 816 mm/sec in the direction X and thus takes 0.5 second for one full rotation.

As shown in FIG. 2, the outer surface 12*a* of the rotary drum 12 has a number of suction apertures 12*d* provided in a belt-like region, adjacent to the particular point, of the outer surface 12*a* of the rotary drum 12 which extends widthwisely of the rotary drum 12 along the center line of rotation 14. One end 12*c* of the rotary drum 12 has a through opening 12*e* therein. Also, the support bracket 70 located opposite to the end 12*c* of the rotary drum 12 has a through opening 70*a* therein. A suction fan device 74 is mounted by a suction duct 73 to the opposite side of the support bracket 70 to the end 12*c* of the rotary drum 12. While the rotary drum 12 rotates, the suction fan device 74 generates and passes a flow of air, denoted by the arrows in FIG. 2, from the suction apertures 12*d* in the outer surface 12*a* of the rotary drum L2 via the suction fan device 74 to the through opening 12*e* of the rotary drum 12 and the through opening 70*a* of the support bracket 70. This develops a negative pressure, at the particular point on the outer surface 12*a* of the rotary drum 12, which in turn holds the leading end of the printing medium supplied to the location Y over the outer surface 12*a* of the rotary drum 12 by the action of the paired transfer rollers 30 and 32. Accordingly, the leading end of the printing medium at the location Y is securely attached to the particular point on the outer surface 12*a* of the rotary drum 12 by a combination of the electrostatic attraction of the charges and the negative pressure. As a result, the holding of the leading end of the printing medium with the printing medium holding finger described later will be carried out without difficulty.

A gap opening radially of the rotary drum 12 is provided between the end 12*c* of the rotary drum 12 and the support bracket 70. This minimizes a difference in the load of suction to the suction fan device 74 between the attraction of the printing medium by suction through the suction apertures 12*d* in the outer surface 12*a* of the rotary drum 12 and the non-attraction of the same.

For attracting the leading end of the printing medium to the particular location by suction, the suction apertures 12*d* may be arranged in a band-like region of the outer surface 12*a* on the rotary drum 12 as described or throughout the entire area of the outer surface 12*a*.

The preheating device 56 shown in FIG. 1 comprises an air input duct 76 mounted in the inner space of the housing 10, a blow fan 78 installed in the air input duct 76, and a heater 80 mounted between the outer surface 12*a* of the rotary drum 12 and the blow fan 78 in the air input duct 76. The air input duct 76 in the embodiment extends from an air intake opening provided in the housing 10 and is separated into two branches to the path of the printing medium between the location Y over the outer surface 12*a* of the rotary drum 12 and the paired transfer rollers 30 and 32 and to the downstream of the initial charger 54 over the outer surface 12*a* along the direction of rotation X of the rotary drum 12.

In action, the first of the two branches of the air input duct 76 decreases the moisture of the printing medium running along the path so the printing medium can easily be attached at the location Y to the outer surface 12*a* of the rotary drum 12 by the attraction of the charges which has been developed with the initial charger 54.

The second branch of the air input duct 76 dries an image of ink printed by the printing equipment 64 on the printing medium which has securely been held to the outer surface 12*a* of the rotary drum 12 at the leading end by the printing medium holding finger, not shown, and at the remaining part by the electrostatic attraction of the charges developed by the initial charger 54 and the negative pressure generated by the suction fan device 74 (FIG. 2).

However, the preheating device 56 may be eliminated when the electrostatic attraction of the charges is strong enough to hold the printing medium and the ink image on the printing medium is instantly dried out by a blow of air produced by the rotation of the rotary drum 12. In that case, one of the branches of the air input duct 76 is eliminated while the other being utilized.

In this embodiment, when the printing medium has been held by suction to the outer surface 12*a* of the rotary drum 12, the rotary drum 12 is driven at the predetermined circumferential speed in the direction X under the control of the controller unit 18 to perform a number of rotations required for printing the image of ink with the printing equipment 64. During the rotations of the drum 12, the charging roller of the initial charger 54 runs over the single printing medium and departs from the outer surface 12*a* of the rotary drum 12. As the rotary drum 12 rotates more than two rotations, the electrostatic attraction charge on the outer surface 12*a* of the rotary drum 12 by the charging roller of the initial charger 54 may be declined while performing full-color printing by the ink jet of the printing equipment, so that the printing medium may be lifted up from the outer surface 12*a* of the rotary drum 12.

For compensation, the sub-charger 58 is provided for applying positive charges to the printing medium which passes beneath the sub-charger 58 when two or more of the rotations of the drum 12 are needed for printing a desired ink image on the printing medium with the printing equipment 64. The quantity of the positive charges applied by the sub-charger 58 to the printing medium when passing beneath the sub-charger 58 is smaller than that applied by the charging roller of the initial charger 54 to the printing medium on the outer surface 12*a* of the rotary drum 12. The sub-charger 58 is of non-contact type which remains spaced from the outer surface 12*a* of the rotary drum 12 not to impair the ink image printed by the printing equipment 64 on the printing medium on the outer surface 12*a* of the rotary drum 12. The non-contact type of the sub-charger 58 may be a corona charger.

The sub-charger 58 may be eliminated in the following case. If the initial charger 54 is of non-contact type such as a corona charger, its generation of the positive charges in a given time is specified in two, high and low, levels which are selectable. The non-contact type of initial charger 54 serves as the initial charger when its generation of the positive charges is at the high level and as the sub-charger when it is at the low level. Meanwhile, the printing medium is securely attached throughout the length to the outer surface 12*a* of the rotary drum 12 by the negative pressure of the printing medium suction unit. It is apparent that any printing medium which has wrinkles while being attached by suction to the outer surface 12*a* of the rotary drum 12 may cause an ink image printed by the printing equipment 64 to be reduced in quality.

As described above, the initial charger 54, the sub-charger 58, and the suction unit (including the suction apertures 12*d* in the outer surface 12*a* of the rotary drum 12, the through openings 12*e* in the end 12*c* of the rotary drum 12, the through opening 70*a* in the support bracket 70, and the suction fan device 74) definitely constitute in a combination the printing medium suction unit for attaching the printing medium to the outer surface 12*a* of the rotary drum 12 by suction.

The discharger 60 in the embodiment is of non-contact type such as a corona charger. The discharger 60 applies negative charges, which are opposite in polarity to the positive charges applied by the initial charger 54 and the sub-charger 58, to the printing medium on the outer surface 12*a* of the rotary drum 12 when the rotary drum 12 has rotated a specific number of times for allowing the printing equipment 64 to print a desired image of ink on the printing medium held on the outer surface 12*a* of the rotary drum 12.

The printing medium removing device 62 in the embodiment is provided with a peel-off finger 82. The peel-off finger 82 is mounted extending in parallel to the center line of rotation 14 of the rotary drum 12 or along the widthwise direction of the rotary drum 12 as shown in FIG. 1. In action, the peel-off finger 82 is driven by a known actuator, not shown, for selectively swinging between the rest position, denoted by the solid line in FIG. 1, spaced from the outer surface 12*a* of the rotary drum 12 and the action position, denoted by the two-dot chain line in FIG. 1, directly on the outer surface 12*a* of the rotary drum 12.

The peel-off finger 82 is normally located at the rest position denoted by the solid line. When the rotary drum 12 has rotated a specific number of times for allowing the printing equipment 64 to print a desired ink image on the recording medium held by suction to the outer surface 12*a* of the rotary drum 12, the peel-off finger 82 moves from the rest position to the action position. More particularly, as the rotary drum 12 has completed the specific number of rotations, the printing medium holding finger, not shown, is moved back to its release position to release the holding of the leading end of the printing medium to the outer surface 12*a* of the rotary drum 12 and simultaneously, the discharger 60 cancels the electrostatic attraction for attaching the printing medium to the outer surface 12*a* of the rotary drum 12. Accordingly, the peel-off finger 82 when moved to its action position can remove the leading end and the remaining portion of the printing medium from the outer surface 12*a* of the rotary drum 12 with much ease.

The printing medium removing device 62 may be constructed in other fashion than the motion of the peel-off finger 82, for example, using the attraction of negative pressure, the ejecting force of compressed air, or the kinetic motion of a pick-up mechanism.

The printing medium removing device 62 is communicated to a printing medium conveying device 84 which extends to a position in the housing 10 located near to the side wall and the top wall thereof.

Figure 3A:
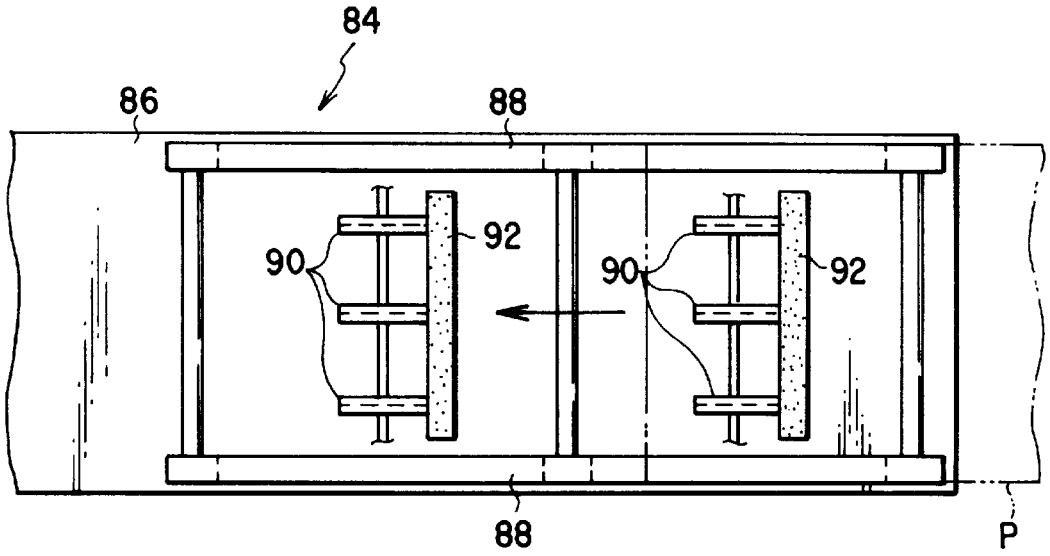
FIG. 3A is a schematic plan view of a printing medium conveying device in the ink jet printer shown in FIG. 1.
Figure 3B:
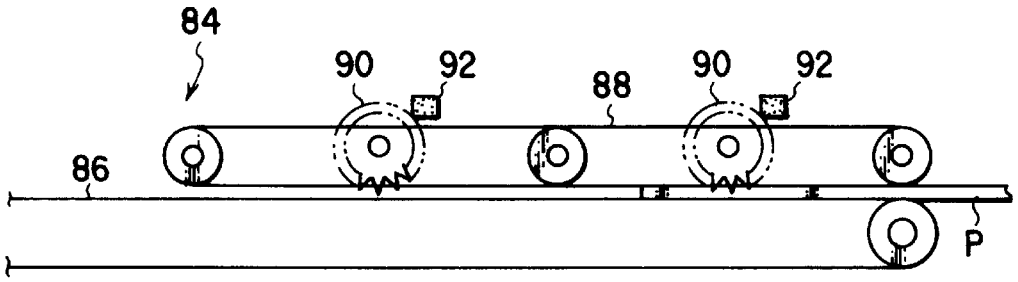
FIG. 3B is a schematic side view of the printing medium conveying device shown in FIG. 3A.
Figure 3C:
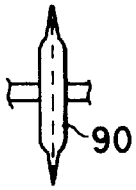
FIG. 3C is a front view of a hold-down roller mounted in the printing medium conveying device shown in FIG. 3A.

FIG. 3A is an enlarged plan view of a primary part of the printing medium conveying device 84. FIG. 3B is an enlarged side view of the primary part of the printing medium conveying device 84 shown in FIG. 3A. FIG. 3C is an enlarged front view of a hold-down roller in the printing medium conveying device 84 shown in FIG. 3A.

Referring to FIGS. 3A to 3C as well as FIG. 1, the printing medium conveying device 84 in the embodiment includes a belt conveyor 86 on which the printing medium P removed from the outer surface 12*a* of the rotary drum 12 by the printing medium removing device 62 is conveyed with its lower side (the non-printed side) down. The belt conveyor 86 can run at substantially the same speed as of the circumferential speed of the outer surface 12*a* of the rotary drum 12 to convey the printing medium P away from the rotary drum 12. The conveying speed of the belt conveyor 86 may be decreased lower than the circumferential speed of the outer surface 12*a* of the rotary drum 12 when the printing medium P has been removed from the outer surface 12*a* of the rotary drum 12. This allows the ink printed on the upper side (the printed side) of the printing medium P to be dried out while being conveyed with the belt conveyor 86. It should be understood that the printing medium P is unloaded from the belt conveyor 86 before the succeeding printing medium is transferred from the outer surface 12*a* of the rotary drum 12 to the belt conveyor 86.

The printing medium conveying means 84 in the embodiment also includes a plurality of hold-down rollers 90 mounted between a pair of hold-down belts 88 above the belt conveyor 86 to cover the area (or a printed region of the upper side of the printing medium) between two widthwise ends of the printing medium P carried on the belt conveyor 86. Each of the hold-down rollers 90 is rotatable in the conveying direction of the printing medium P on the belt conveyor 86 and is pressed against the belt conveyor 86 in the area (or the printed region of the upper side of the printing medium) between the two widthwise ends of the printing medium P carried on the belt conveyor 86. To prevent unwanted damage to the area (or the printed region of the upper side of the printing medium) between the two widthwise ends of the printing medium P carried on the belt conveyor 86, the outer edge of the hold-down roller 90 has a width small enough to hold the printing medium P intact and is shaped like a star pattern on the side. The outer edge of the hold-down roller 90 is kept in direct contact with an ink cleaning member 92 such as a sponge or felt material for cleaning of the roller 90 to protect the printed region of the printing medium P. The hold-down rollers 90 prevent the printing medium P from lifting up from th e upper surface of the belt conveyor 86 when being conveyed on the belt conveyor 86. Accordingly, as the printing medium P is prevented from lifting up or dropping off the belt conveyor 86, it will hardly cause a collision or a jamming on the belt conveyor 86. The hold-down rollers 90 rarely assault and impair the area (or the printed region of the upper side of the printing medium) between the two widthwise ends of the printing medium P carried on the belt conveyor 86.

An ink drying device 94 is mounted above a down st ream region of the belt conveyor 86 for drying the ink of the image printed on the upper side of the printing medium P conveyed on the belt conveyor 86. The ink drying device 94 is preferably a known heater. The ink drying device 94 may be eliminated if the ink of the image printed on the upper side of the printing medium P can be dried out before being transferred by the printing medium removing device 82 from the outer surface 12*a* of the rotary drum 12 to the belt conveyor 86.

A printing medium conveying direction switching device 96 is provided at the terminal end of the downstream region of the belt conveyor 86 in the housing 10. The switching device 96 comprises a known gate member for selectively guiding the printing medium in either the vertical or horizontal direction after the printing medium arrives at the terminal end of the downstream region of the belt conveyor 86.

The switching device 96 for selecting the conveying direction of the printing medium P from the belt conveyor 86 is connected at the downstream side to a printing medium conveying guide 98 which defines a path for conveying the printing medium and comprises two branches. One branch 98*a* of the printing medium conveying guide 98 extends upwardly from the switching device 96 and is communicated at the exit end to an opening provided in the top of the housing 10. At the exit end, a pair of discharge rollers 100 are mounted for discharging the printing medium P conveyed from the terminal end of the downstream portion of the belt conveyor 86 to the switching device 96 and the branch 98*a* of the printing medium conveying guide 98. The printing medium P discharged by the paired discharge rollers 100 is then deposited with its printed side down in a stack on a printing medium stacker 102.

The other branch 98*b* of the printing medium conveying guide 98 extends horizontally from the switching device 96 and is communicated at the exit end with an opening provided in the side of the housing 10. A discharged printing medium tray 104 is detachably or openably mounted to the side of the housing 10 for communication via the opening to the exit end of the horizontal branch 98*b*. The printing medium P discharged from the opening is deposited with its printed side up in a stack on the discharged printing medium tray 104.

In this embodiment, the housing 10 is arranged openable at the top 10*a* for maintenance service for the components mounted in the inner space of the housing 10. The housing 10 when in its open state is denoted at the top 10*a* by the two-dot chain line in FIG. 1. The housing 10 may be openable on the side(s) for ease of maintenance service.

The printing equipment 64 in the embodiment comprises a group of ink jet printing heads 102C, 102M, 102Y, and 102B arranged at equal distance from each other along the outer surface 12*a* of the rotary drum 12 circumferentially of the drum 12. The printing heads 102C, 102M, 102Y, and 102B extend parallel to each other and to the center line of rotation 14 of the rotary drum 12 and along the radial direction of the rotary drum 12.

The printing heads 102C, 102M, 102Y, and 102B are supportedly mounted by a support 104 to a forward and backward movable table 108 in an axially traveling mechanism 106. The axially traveling mechanism 106 is mounted by a radially traveling mechanism 110 to a particular location in the inner space of the housing 10.

The axially traveling mechanism 106 is designed for selectively moving the printing heads 102C, 102M, 102Y, and 102B within a given reciprocating range along the center line of rotation 14 of the rotary drum 12. As schematically shown in a plan view of FIG. 4, the axially traveling mechanism 106 also includes a frame 112 supported on the radially traveling mechanism 110 shown in FIG. 1 and a plurality of guide bars 114 extending along and in parallel with the center line of rotation 14 of the rotary drum 12 and with each other. The forward and backward movable table 108 is mounted on the guide bars 114 for forward and backward movements in a specific reciprocating range along the center line of rotation 14 of the rotary drum 12.

A forward and backward movement drive source 116 is mounted to one side of the frame 112, which is a known shaft-projectable/retractable step motor 118 in the embodiment. The shaft-projectable/retractable step motor 118 has an output shaft 119 arranged movable in a specific reciprocating range along its axis corresponding to the direction of rotation and the angle of rotation. One end of the output shaft 119 is rotatably linked to a corresponding side of the forward and backward movable table 108. A rattling preventing urging member 120 is mounted between the side of the frame 112 and the corresponding side of the forward and backward movable table 108 for urging the forward and backward movable table 108 in a direction parallel to the guide bars 114. The rattling preventing urging member 120 may be a compression spring or a tension spring.

The radially traveling mechanism 110 is designed for selectively moving the printing heads 102C, 102M, 102Y, and 102B to and from the outer surface 12*a* of the rotary drum 12 radially of the same.

As shown in FIG. 1, the radially traveling mechanism 110 comprises a rack 122 located beneath the frame 112 of the axially traveling mechanism 106 to extend radially of the rotary drum 12 and a pinion 124 engaged with the rack 122. The pinion 124 is rotatably mounted on a support, not shown, anchored in the housing 10 and driven by the rotation of a rotation drive mechanism such as a motor, not shown. The radially traveling mechanism 110 drives the printing heads 102C, 102M, 102Y, and 102B to move away from their respective printing locations, shown in FIG. 1, together with the axially traveling mechanism 106 when they are not in use for more than a predetermined length of time and return back from their away locations to the printing locations together with the radial traveling mechanism 106 when they are requested for use.

In this embodiment, a printing heads protective mechanism 126 is provided beneath the radially traveling mechanism 110 in the inner space of the housing 10. The printing heads protective mechanism 126 is mounted on a vertically traveling mechanism 128 located in the inner space of the housing 10. The vertically traveling mechanism 128 is designed for selectively moving the printing heads protective mechanism 126 in upward and downward directions. More particularly, while the printing heads 102C, 102M, 102Y, and 102B are at their printing locations, shown in FIG. 1, with the radially traveling mechanism 110, the vertically traveling mechanism 128 holds the printing heads protective mechanism 126 to its lowermost location shown in FIG. 1. When the printing heads 102C, 102M, 102Y, and 102B have been moved from the printing locations, shown in FIG. 1, to the away locations by the radially traveling mechanism 110, the vertically traveling mechanism 128 drives the printing heads protective mechanism 126 from the lowermost location, shown in FIG. 1, to the uppermost location where it is situated between the ink jet nozzle ends (facing the outer surface 12*a* of the rotary drum 12) of the printing heads 102C, 102M, 102Y, and 102B at their away locations and the outer surface 12*a* of the rotary drum 12. The printing heads protective mechanism 126 at the uppermost location covers over the ink jet nozzle ends, not shown, of the printing heads 102C, 102M, 102Y, and 102B to protect their ink ejecting apertures and prevent them from fouling with remaining ink.

Figure 5:
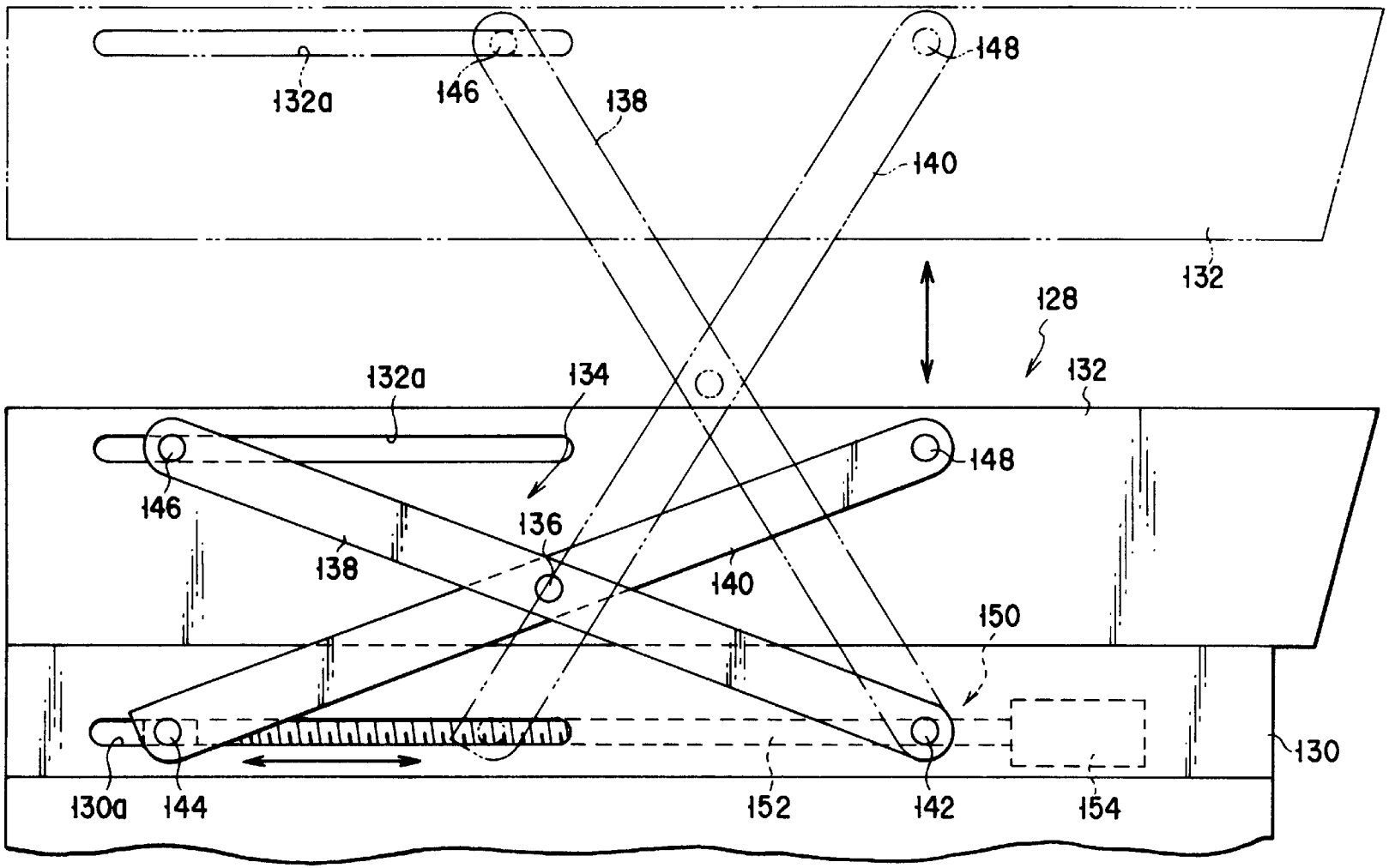
FIG. 5 is an enlarged schematic side view of a vertical traveling mechanism for a printing head protective mechanism in the ink jet printer shown in FIG. 1.

As schematically shown in a side view of FIG. 5, the vertically traveling mechanism 128 in the embodiment comprises a stationary frame 130 anchored in the inner space of the housing 10 and a vertically movable frame 132 mounted on the stationary frame 130. The printing heads protective mechanism 126 (FIG. 1) is mounted on the upper side of the vertically movable frame 132. The stationary frame 130 and the vertically movable frame 132 are joined to each other by a known upward and downward movable parallel link mechanism 134.

The upward and downward movable parallel link mechanism 134 includes a pair of link bars 138 and 140 of substantially the same length intersecting each other at a center position and joined to each other by a pivot pin 136 for pivotal motion to each other. The lower end of the link bar 138 is pivotably linked by a pivot pin 142 to one side of the stationary frame 130. The lower end of the link bar 140 is joined to a horizontally movable pin 144 which is slidably fitted into a substantially horizontally extending guide slot 130*a* provided in the side of the stationary frame 130. The upper end of the link bar 138 is joined to a horizontally movable pin 146 which is slidably fitted into a substantially horizontally extending guide slot 132*a* provided in one side of the vertically movable frame 132. The upper end of the link bar 140 is pivotably linked by a pivot pin 148 to the side of the vertically movable frame 132. Also, the link bar 138 is connected at the lower end to a horizontal movement drive device 150. The horizontal movement drive device 150 in the embodiment comprises a lead screw 152 threaded into the lower end of the link bar 140 or the horizontally movable pin 144 linked to the link bar 140, and a rotation drive device 154 such as a motor for selectively rotating the lead screw 152 in one or opposite directions.

When the lead screw 152 is rotated in one direction by the rotation drive device 154 with the vertically movable frame 132 located at its lowermost position denoted by the solid line in FIG. 5, the lower end of the link bar 140 moves from its left end position denoted by the solid line in FIG. 5 to its right end position denoted by the two-dot chain line. The movement of the link bar 140 causes the vertically movable frame 132 to travel in parallel from the lowermost position denoted by the solid line in FIG. 5 to the uppermost position denoted by the two-dot chain line together with the printing heads protective mechanism 126 (FIG. 1). When the lead screw 152 is rotated in the opposite direction by the rotation drive device 154 with the vertically movable frame 132 located at its uppermost position denoted by the two-dot chain line in FIG. 5, the lower end of the link bar 140 moves from the right end position denoted by the two-dot chain line to the left end position denoted by the solid line in FIG. 5. The movement of the link bar 140 causes the vertically movable frame 132 to travel in parallel from the uppermost position denoted by the two-dot chain line in FIG. 5 to the lowermost position denoted by the solid line in FIG. 5 together with the printing heads protective mechanism 126 (FIG. 1).

Figure 6:
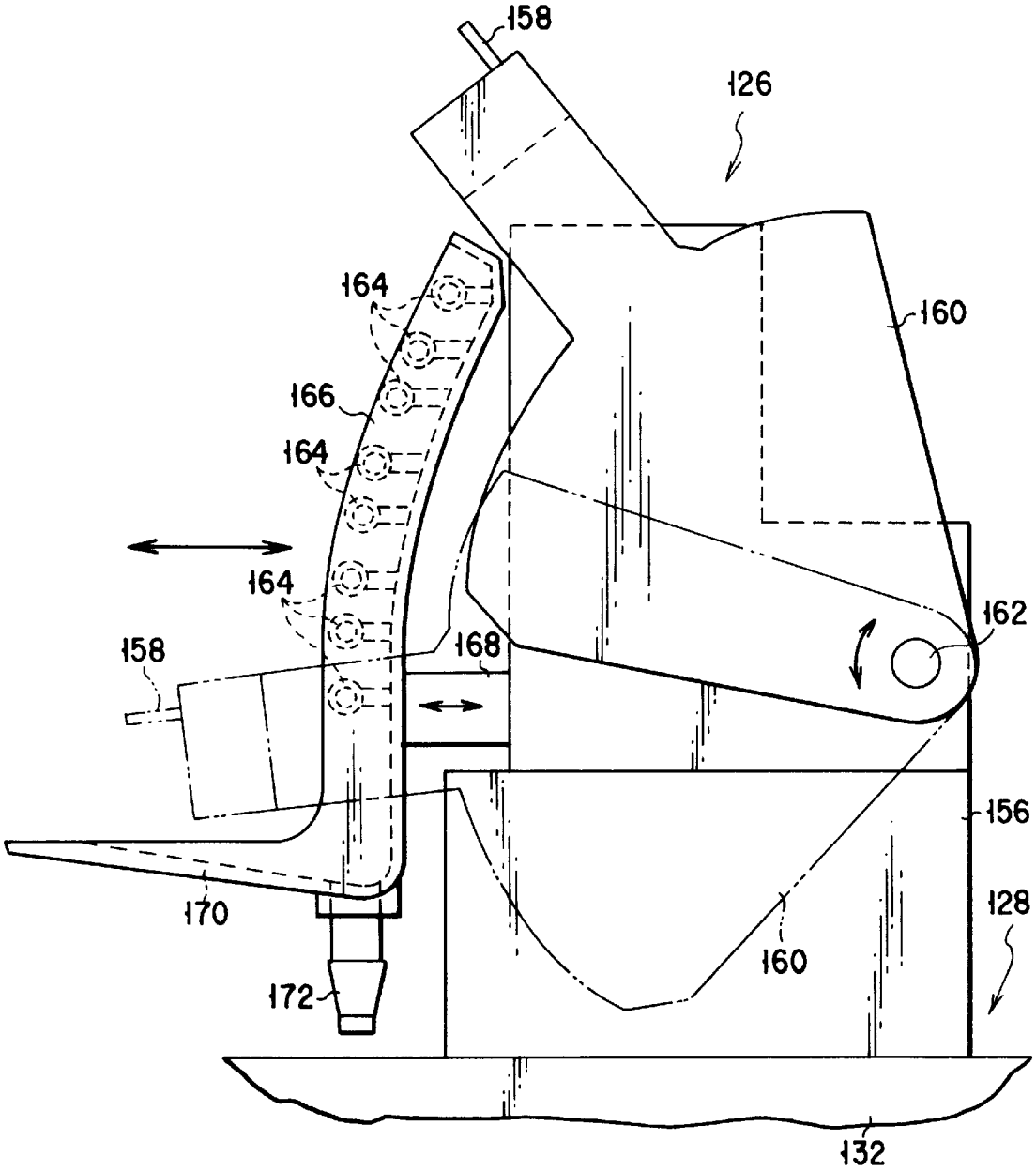
FIG. 6 is an enlarged schematic side view of the printing head protective mechanism in the ink jet printer shown in FIG. 1.

FIG. 6 illustrates an enlarged side view of the printing heads protective mechanism 126 mounted on the upper side of the vertically movable frame 132 in the vertically traveling mechanism 128. As shown in FIG. 6, the printing heads protective mechanism 126 includes a support bed 156 fixedly mounted on the upper side of the vertically movable frame 132. The support bed 156 has a swing member 160 pivotably mounted on a pivot axis 162 thereof and provided with a wiper blade 158. The swing member 160 is selectively swung by a known swing drive device, not shown, mounted in the support bed 156 to perform the upward and downward reciprocating motions of the wiper blade 158.

More specifically, the swing member 160 is located at the uppermost position denoted by the solid line in FIG. 6 when the vertically movable frame 132 of the vertically traveling mechanism 128 stays at the lowermost position denoted by the solid line in FIG. 5 (with the printing heads 102C, 102M, 102Y, and 102B of the printing equipment 64 remaining at their printing positions shown in FIG. 1). When the vertically movable frame 132 of the vertically traveling mechanism 128 is moved to the uppermost position denoted by the two-dot chain line in FIG. 5 (with the printing heads 102C, 102M, 102Y, and 102B of the printing equipment 64 shifting from the printing positions shown in FIG. 1 to the away positions not shown), the swing member 160 repeats the upward and downward reciprocating motion a given number of times between the uppermost position denoted by the solid line and the lowermost position denoted by the two-dot chain line in FIG. 6. The upward and downward reciprocating motion of the swing member 160 allows the wiper blade 158 to wipe the ink jet nozzle ends (facing the outer surface 12*a* of the rotary drum 12) of the printing heads 102C, 102M, 102Y, and 102B held at the away positions. After the number of the upward and downward reciprocating motions is completed, the swing member 160 is returned back to the uppermost position denoted by the solid line in FIG. 6.

The printing heads protective mechanism 126 also includes a cap member support frame 166 which supports a plurality of long cap members 164 extending in the same direction as of the printing heads 102C, 102M, 102Y, and 102B shown in FIG. 1. The cap member support frame 166 is mounted by a known horizontally moving mechanism 168 to the support bed 156. The long cap members 164 on the cap member support frame 166 come opposite to the ink jet nozzle ends (facing the outer surface 12*a* of the rotary drum 12) of the printing heads 102C, 102M, 102Y, and 102B at the away positions when the vertically movable frame 132 of the vertically traveling mechanism 128 is moved to the uppermost position denoted by the two-dot chain line in FIG. 5 (with the printing heads 102C, 102M, 102Y, and 102B of the printing equipment 64 shifting from the printing positions shown in FIG. 1 to the away positions not shown).

Although four of the ink jet nozzle ends of the printing heads 102C, 102M, 102Y, and 102B are illustrated in FIG. 1, the cap member support frame 166 carries eight of the cap members 164 arranged vertically at equal intervals. This is because each of the printing heads 102C, 102M, 102Y, and 102B includes two vertically spaced rows of ink jet segments aligned along the center line of rotation 14 of the rotary drum 12 (FIG. 1) as will be explained later in more detail.

After the number of the upward and downward reciprocating motions of the swing member 160 is completed, the cap member support frame 166 is horizontally moved (to the left in FIG. 6) by the known horizontally moving mechanism 168 from the backward position shown in FIG. 6 to the forward position where it faces the ink jet nozzle ends of the printing heads 102C, 102M, 102Y, and 102B, thus pressing the cap members 164 against the corresponding ink jet nozzle ends of (more precisely, the ink jet segments of) the printing heads 102C, 102M, 102Y, and 102B. The cap members 164 in the embodiment are made of an elastic material for definitely sealing the corresponding ink jet nozzle ends without doing damage. In FIG. 6, the cap members 164 have a tubular shape in cross section which is most preferable for the elastic material.

Immediately before the vertically movable frame 132 of the vertically traveling mechanism 128 shown in FIG. 5 starts moving from the uppermost position denoted by the two-dot chain line to the lowermost position denoted by the solid line of FIG. 5, the cap member support frame 166 is moved back (to the right in FIG. 6) by the known horizontally moving mechanism 168 from the forward position where the cap members 164 press against the corresponding ink jet nozzle ends of the printing heads 102C, 102M, 102Y, and 102B of the printing equipment 64 at the away positions (FIG. 1) to the backward position where the cap members 164 are spaced from the corresponding ink jet nozzle ends as shown in FIG. 6. As the cap member support frame 166 has been returned to the backward position shown in FIG. 6, the vertically movable frame 132 of the vertically traveling mechanism 128 shown in FIG. 5 travels from the uppermost position denoted by the two-dot chain line to the lowermost position denoted by the solid line in FIG. 5 together with the printing heads protective mechanism 126 and then, the printing heads 102C, 102M, 102Y, and 102B of the printing equipment 64 (FIG. 1) are moved by the radially traveling mechanism 110 (FIG. 1) from the away positions, not shown, to the printing positions shown in FIG. 1 for starting the printing action.

Referring to FIG. 6, an ink receiver 170 which extends in the same direction as of the printing heads 102C, 102M, 102Y, and 102B of the printing equipment 64 shown in FIG. 1 is mounted to the lower end of the cap member support frame 166. The ink receiver 170 receives drops of the ink which fall down from the ink jet nozzle ends of the printing heads 102C, 102M, 102Y, and 102B of the printing equipment 64 at the away positions due to the upward and downward reciprocating motion of the swing member 160 with the wiper blade 158 or the pressing of the cap members 164 against the corresponding ink jet nozzle ends. The ink receiver 170 can also receive drops of the ink falling from the ink jet nozzle ends of the printing heads 102C, 102M, 102Y, and 102B while the printing heads protective mechanism 126 together with the vertically movable frame 132 of the vertically traveling mechanism 128 stays at the lowermost position shown in FIG. 5 (with the printing heads 102C, 102M, 102Y, and 102B of the printing equipment 64 located at the printing positions shown in FIG. 1). There is an ink discharge pipe 172 connected to a discharged ink tank not shown in FIG. 6.

Figure 7:
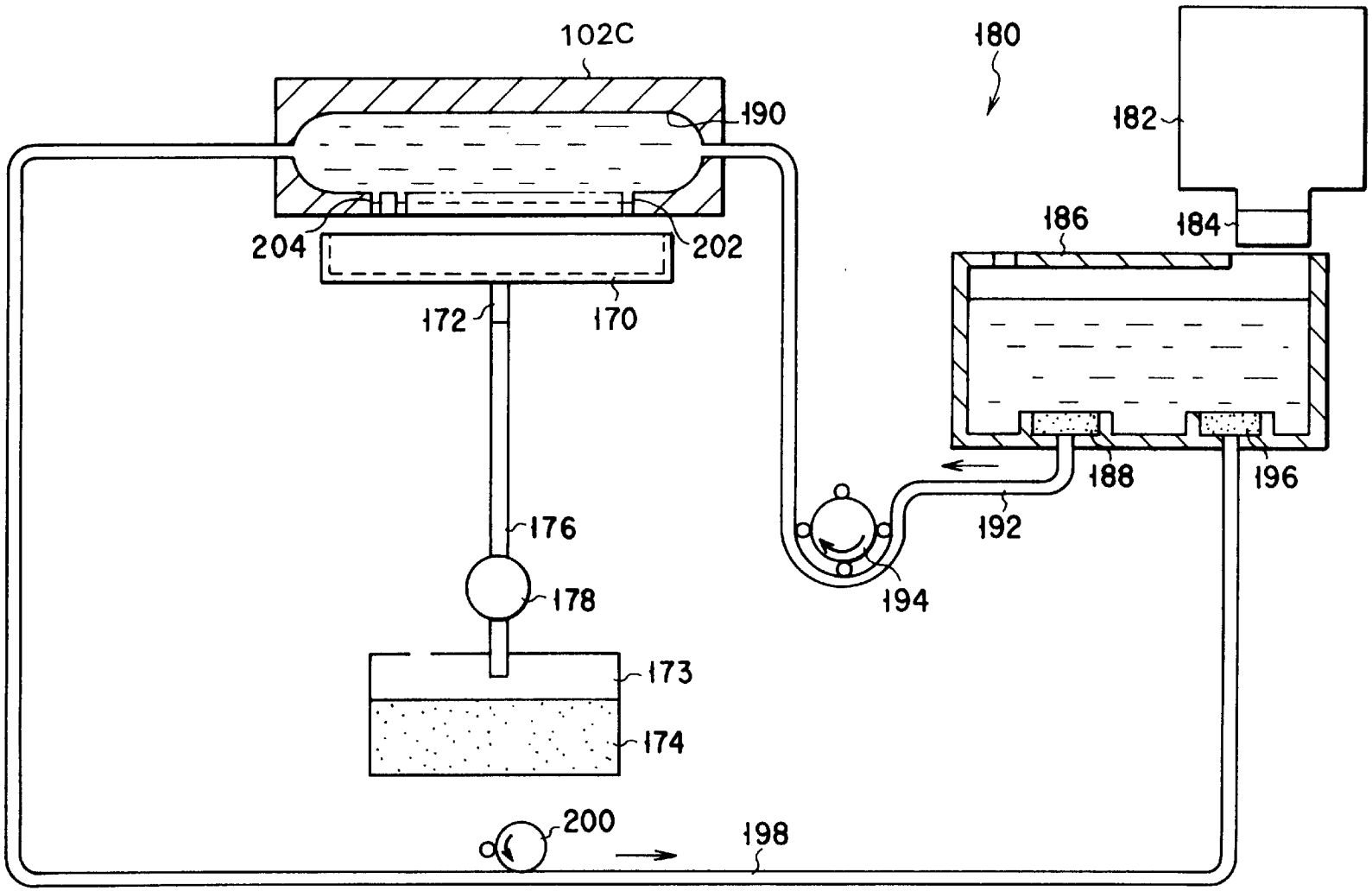
FIG. 7 is a schematic view of an ink supplying means of the printing equipment in the ink jet printer shown in FIG. 1.

FIG. 7 schematically illustrates an arrangement of an ink supplying device 180 for supplying each of the printing heads 102C, 102M, 102Y, and 102B of the printing equipment 64 shown in FIG. 1 with a flow of ink. Also shown in FIG. 7 is a discharged ink tank 173 connected to the ink discharge pipe 172 from the ink receiver 170. The discharged ink tank 173 contains an ink absorbing material 174 such as sponge and of which inlet is communicated by a discharged ink tube 176 to the ink discharge pipe 172. The discharged ink tube 176 may be equipped with an ink suction pump 178 if desired.

The printing heads 102C, 102M, 102Y, and 102B of the printing equipment 64 shown in FIG. 1 are supplied with their respective inks of different colors from the corresponding ink supplying device 180. In this embodiment, the printing heads 102C, 102M, 102Y, and 102B are supplied with a cyan color ink, a magenta color ink, a yellow color ink, and a black ink respectively. While the rotary drum 12 shown in FIG. 1 performs the specific number of rotations, a full color image can be printed on the printing medium P attached on the outer surface 12*a* of the rotary drum 12 according to an image signal supplied to the printing equipment 64.

The number of the printing heads in the printing equipment 64 is not limited to four but may be any desired number. If two printing heads for printing light red and blue are added to the printing heads 102C, 102M, 102Y, and 102B in the printing equipment 64, the quality of each full color image will be enhanced.

The ink supplying device 180 for the corresponding printing heads 102C, 102M, 102Y, and 102B are identical in the arrangement; the arrangement of the ink supplying device 180 shown in FIG. 7 is for the printing head 102C. The ink supplying device 180 comprises an ink tank 186 to which an ink cassette 182 for carrying a cyan color ink for the printing head 102C is detachably mounted by a known level maintaining device 184, an ink feed tube 192 extending from the ink tank 186 via a filter 188 to the printing head 102C and connected to an ink reservoir 190 in the ink printing head 102C, an ink pressurizing pump 194 mounted across the ink feed tube 192, an ink return tube 198 extending from the ink reservoir 190 in the printing head 102C via a filter 196 to the ink tank 186, and a tube open/close valve 200 mounted across the ink return tube 198.

The ink tanks 186 in the embodiment are opened to the atmosphere while their respective printing heads 102C, 102M, 102Y, and 102B are in use. When the ink pressurizing pump 194 is turned on with the tube open/close valve 200 being open, the cyan color ink circulates from the ink tank 186 to the ink feed tube 192, the ink reservoir 190 in the printing head 102C, and the ink return tube 198. Upon the ink open/close valve 200 being closed, the remaining of the cyan color ink in the printing head 102C is discharged from the ink jet nozzle apertures 202 by the pressure developed by the ink pressurizing pump 194 (causing a prime phenomenon). Accordingly, the ink jet nozzle apertures 202 will be bleeding and be prevented from being fouled. When the ink jet nozzle aperture 202 is accompanied with a known ink ejecting element 204 (for example, a piezoelectric device) for ejecting a jet of the cyan color ink through the ink jet nozzle aperture 202 (producing a spit effect) similar to the printing action, its bleeding and prevention from being fouled will be conducted more effectively.

After the ejection for air bleeding and prevention from being fouled is carried out, the ink pressurizing pump 194 stops and the tube open/close valve 200 is opened again. As jets of the cyan color ink have been ejected out from the ink jet nozzle apertures 202 for printing the image, the ink reservoir 190 is replenished with a fresh supply of the cyan color ink from the ink tank 186 using a capillary action in the ink return tube 198.

In this embodiment, differences between the levels of the inks in the respective ink tanks 186 for the printing heads 102C, 102M, 102Y, and 102B and the heights of the corresponding ink jet nozzle apertures 202 of the printing heads 102C, 102M, 102Y, and 102B are finely controlled depending on the types of the inks (which are different in the specific gravity, the viscosity, and other properties) so that the inks at the ink jet nozzle apertures 202 of their respective printing heads 102C, 102M, 102Y, and 102B are indented to an equal depth by the effect of surface tension (or the meniscus effect).

This allows the drops of the inks ejected from the ink jet nozzle apertures 202 of the printing heads 102C, 102M, 102Y, and 102B to be uniform in size thus increasing the quality of the image printed with the printing heads 102C, 102M, 102Y, and 102B of the printing equipment 64. For the purpose, the level of the ink in the ink tank 186 for each of the printing heads 102C, 102M, 102Y, and 102B is set lower than the height of the ink jet nozzle aperture 202 of the printing head 102C, 102M, 102Y, or 102B.

Figure 8:
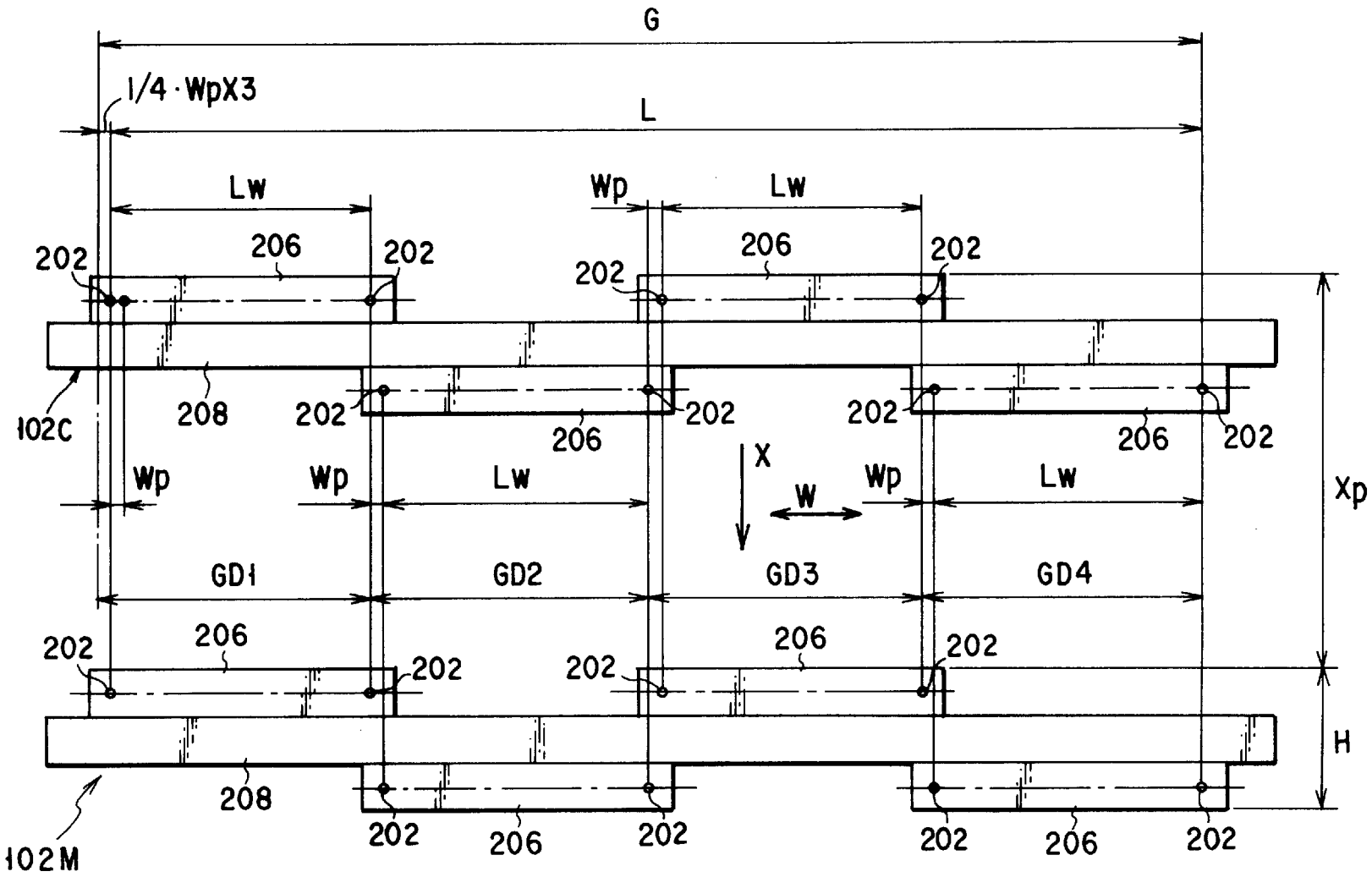
FIG. 8 is an enlarged schematic front view of two adjacent printing heads out of four printing heads of the printing equipment in the ink jet printer shown in FIG. 1.

FIG. 8 is an enlarged front view of two adjacent ones 102C and 102M of the printing heads 102C, 102M, 102Y, and 102B of the printing equipment 64 shown in FIG. 1. The printing heads 102C, 102M, 102Y, and 102B are identical in construction.

As shown in FIG. 8, each of the printing heads 102C, 102M, 102Y, and 102B consists of two rows of the ink jet segments 206 arranged at equal intervals along the widthwise direction W in parallel to the center line 14 of rotation of the rotary drum 12 shown in FIG. 1, the two rows distanced from each other in the direction X of rotation of the rotary drum 12. More specifically, the ink jet segments 206 of each of the printing heads 102C, 102M, 102Y, and 102B are arranged in two, upstream and downstream, rows distanced from each other along the direction X of rotation. The ink jet segments 206 are aligned in the widthwise direction W in a zigzag so that each the ink jet segments 206 at the downstream row is sandwiched between the two ink jet segments 206 at the upstream row or vise versa. The ink jet segments 206 of the two, upstream and downstream, rows are alternately mounted to both sides of an ink jet segment support rod 208 which extends in the widthwise direction W.

Each of the four ink jet segments 206 shown in FIG. 8 has a number of ink jet nozzle apertures 202 provided therein at equal intervals of a pitch Wp. The distance along the widthwise direction W between the two far end ink jet nozzle apertures 202 of any two adjacent ink jet segments 206 at the two rows respectively is equal to Wp of the pitch between any two adjacent ink jet apertures 202 in one ink jet segment 206.

The ink jet nozzle apertures 202 in the corresponding ink jet segments 206 of the printing heads 102C, 102M, 102Y, and 102B are aligned one another along the direction X of rotation.

Since the ink jet segments 206 are arranged in a zigzag for each of the printing heads 102C, 102M, 102Y, and 102B, the pitch Wp between the two ink jet nozzle apertures 202 will be minimized without employing a particular technique and thus increasing the cost of production for the printing heads 102C, 102M, 102Y, and 102B of the printing equipment 64. If the cost of production is not critical or the pitch Wp between the two ink jet nozzle apertures 202 is greater than that in the embodiment, the ink jet segments 206 for each of the printing heads 102C, 102M, 102Y, and 102B may be linearly aligned along the widthwise direction W.

In this embodiment, the distance Lw between the two far end ink jet nozzle apertures 202 in the ink jet segment 206 for each of the printing heads 102C, 102M, 102Y, and 102B is 2.11 inches. Throughout the distance Lw, 159 of the ink jet nozzle apertures 202 are provided. More particularly, the pitch Wp between any two adjacent ink jet nozzle apertures 202 is 1/75 inch. The distance H between both edges of the two rows of the ink jet segments 206 is 9 mm along the direction X of rotation. The distance between the two far end ink jet nozzles apertures 202 of the two adjacent ink jet segments 206 arranged in a zigzag is also 1/75 inch equal to the pitch Wp between any two adjacent ink jet nozzle apertures 202 of each segment 206.

Also, the distance Xp between any two adjacent ink jet segments 206 of two of the printing heads 102C, 102M, 102Y, and 102B along the direction X of rotation is 20 mm.

While the printing heads 102C, 102M, 102Y, and 102B of the printing equipment 64 are located at their printing positions as shown in FIG. 1, the ink jet nozzle ends of the ink jet segments 206 for the printing heads 102C, 102M, 102Y, and 102B are spaced by 1 mm from the outer surface 12*a* of the rotary drum 12.

The duration when one jet of ink is applied from the corresponding ink jet nozzle aperture 202 of the ink jet segment 206 for the printing head 102C, 102M, 102Y, or 102B is 0.1 msec (for printing one dot of the image).

Figure 4:
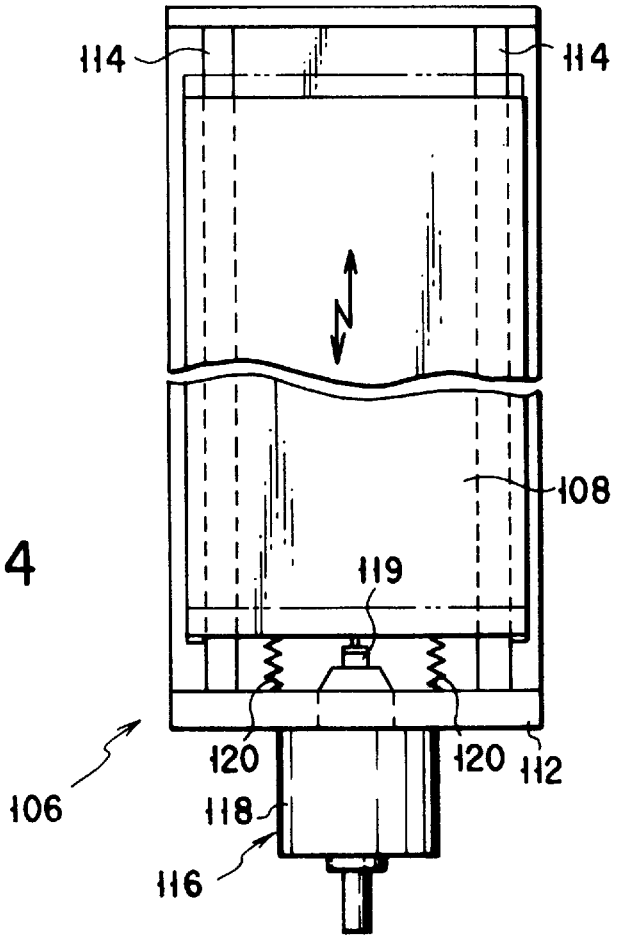
FIG. 4 is a schematic plan view of an axially traveling mechanism of a printing equipment in the ink jet printer shown in FIG. 1.
Figure 9:
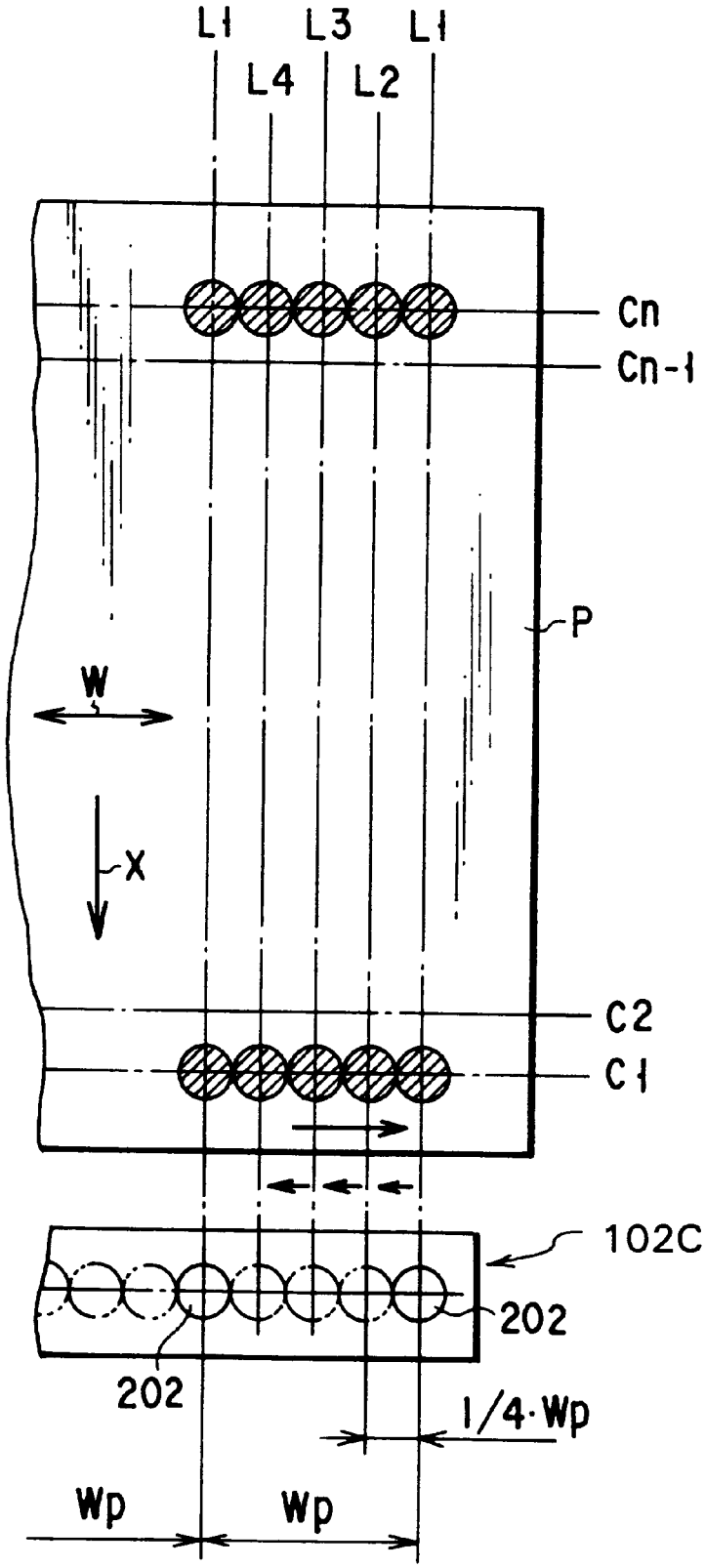
FIG. 9 is a schematic view showing an action of printing an image on the printing medium with one of the printing heads shown in FIG. 8.

FIG. 9 schematically illustrates the four printing heads 102C, 102M, 102Y, and 102B arranged as shown in FIG. 8 and the axially forward and backward traveling mechanism 106 arranged as shown in FIGS. 1 and 4 operating in a combination for printing a desired image on the printing medium P held at the specific location on the outer surface 12*a* of the rotary drum 12 during the number of rotations of the rotary drum 12 shown in FIG. 1.

More specifically, while the rotary drum 12 shown in FIG. 1 performs four full rotations, the printing heads 102C, 102M, 102Y, and 102B of the printing equipment 64 are actuated to print the desired image on the printing medium P held on the outer surface 12*a* of the rotary drum 12. As one full rotation of the rotary drum 12 shown in FIG. 1 takes 0.5 second, the image on the printing medium P will be printed in two seconds.

For locating the printing medium P to the specific location on the outer surface 12*a* of the rotary drum 12 and removing the printing medium P from the outer surface 12*a* of the rotary drum 12, the rotary drum 12 rotates two times, one for each action. Accordingly, during the period in which the printing medium P is located to the specific location on the outer surface 12*a* of the rotary drum 12, printed with a desired image, and removed from the outer surface 12*a* of the rotary drum 12, six full rotations of the rotary drum 12 is needed and takes 3 seconds. As a result, 20 full color images can be printed in one minute.

More particularly, while the rotary drum 12 shown in FIG. 1 turns one full rotation, the printing heads 102C, 102M, 102Y, and 102B are driven by the action of the axially forward and backward traveling mechanism 106 arranged as shown in FIGS. 1 and 4 to move 1/4 of the pitch Wp (1/75 inch) between the ink jet nozzle apertures 202 of the ink jet segment 206 (1/75 inch×1/4=1/300 inch) in the widthwise direction W (to the left in FIG. 9) along the center line 14 of rotation of the rotary drum 12. This allows the ink jet nozzle apertures 202 to eject jets of the ink in response to the image signal from the controller unit 18 (FIG. 1) for printing a series of dots from C1 to Cn along the first dot column L1 during a first one of the four rotations of the rotary drum 12 shown in FIG. 1. When the rotary drum 12 shown in FIG. 1 has conducted the first rotation, the printing heads 102C, 102M, 102Y, and 102B are moved 1/4 Wp in the widthwise direction W (to the left in FIG. 9) by the axially forward and backward traveling mechanism 106 shown in FIGS. 1 and 4 before the rotary drum 12 starts the second rotation (more specifically before the ink jet nozzle aperture 202 departs from the last dot Cn and returns to the first dot C1). During the second rotation of the rotary drum 12 shown in FIG. 1, the ink jet nozzle apertures 202 deliver jets of the ink in response to the image signal from the controller unit 18 (FIG. 1) to print a series of dots from C1 to Cn along the second column L2. This action is repeated until the rotary drum 12 shown in FIG. 1 completes the four rotations. As the result, a matrix of dots according to the image signal from the controller unit 18 (FIG. 1) are printed from C1 at the first column L1 to Cn of the fourth column L4 with the jets of the ink applied from each of the ink jet nozzle apertures 202.

With the four printing heads 102C, 102M, 102Y, and 102B, an image at a resolution of 300 dpi can be printed throughout a width range G, which is a sum of the distance L between the two outermost ink jet nozzle apertures 202 of the ink jet segments 206 aligned in the widthwise direction W (FIG. 8) and the distance of three pitch movements of the ink jet nozzle apertures 202 (1/4 Wp×3), on the printing medium P held at the particular location on the outer surface 12*a* of the rotary drum 12 shown in FIG. 1. In four sections GD1, GD2, GD3, and GD4 divided from the width range or image printable range G, portions of the image are printed with their respective printing heads 102C, 102M, 102Y, and 102B applying jets of the inks from the ink jet nozzle apertures 202.

When the rotary drum 12 shown in FIG. 1 has conducted four rotations to print a full color image on the printing medium P, the axially forward and backward traveling mechanism 106 shown in FIGS. 1 and 4 drives the four printing heads 102C, 102M, 102Y, and 102B to return with the ink jet nozzle apertures 202 from the final dot point at the fourth column L4 to the start dot point at the first column L1 during the fifth rotation of the rotary drum 12 for removing the printing medium P from the particular location on the outer surface 12*a* of the rotary drum 12.

The combination action of the four printing heads 102C, 102M, 102Y, and 102B and the axially forward and backward traveling mechanism 106 shown in FIGS. 1 and 4 permits the image to be printed on the printing medium P held at the particular location on the outer surface 12*a* of the rotary drum 12 at a desired degree of resolution by varying the number of rotations of the rotary drum 12 shown in FIG. 1 for printing a full color and the pitch of movement of the four printing heads 102C, 102M, 102Y, and 102B.

Figure 10:
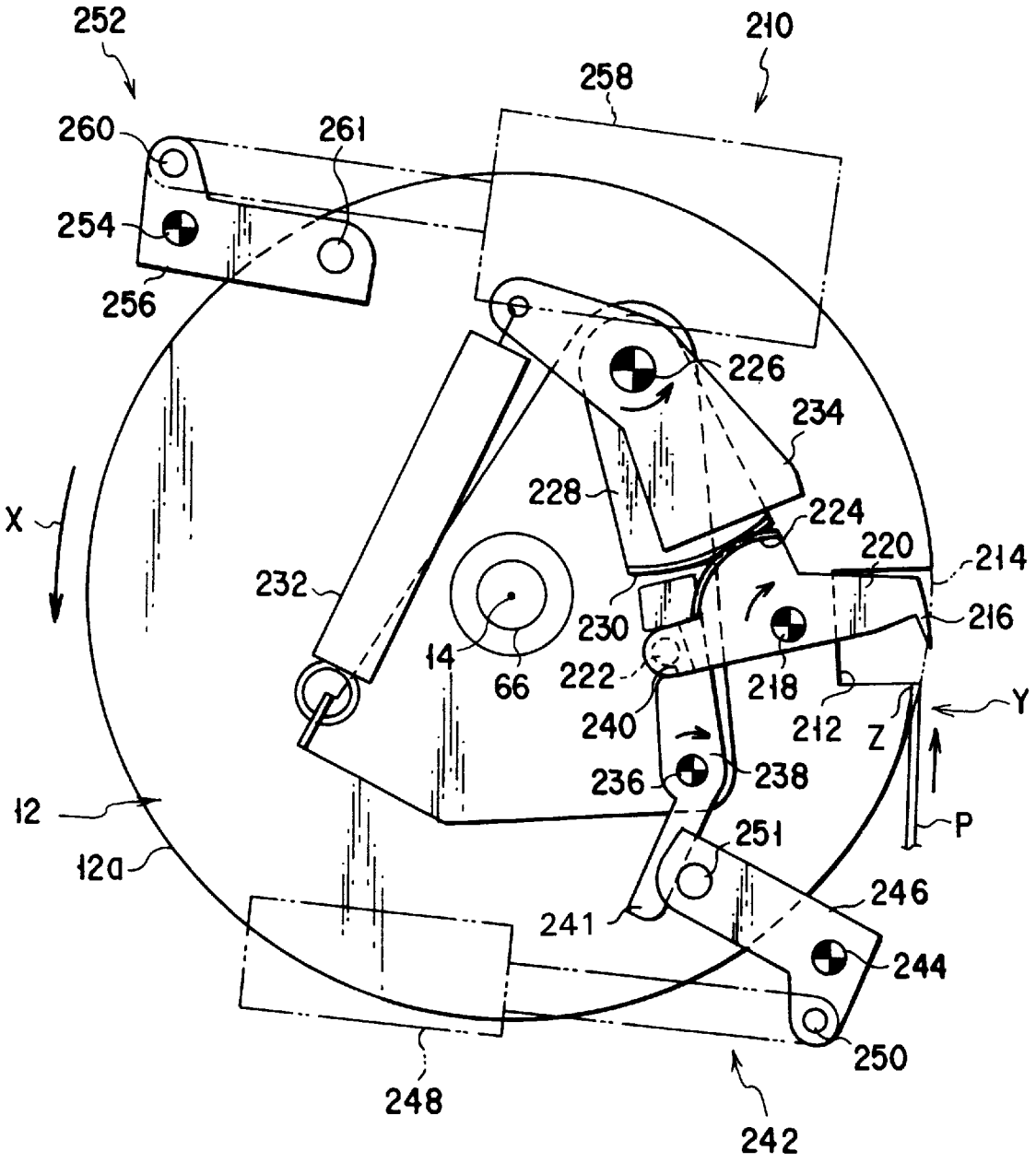
FIG. 10 is an enlarged schematic side view of a printing medium holding device for detachably holding the leading end of the printing medium onto a particular point on the outer surface of the rotary drum in the ink jet printer shown in FIG. 1, illustrating a state just before holding the leading end of the printing medium.

FIG. 10 is a side view of the printing medium holding device 210 for holding to the particular zone Z on the outer surface 12*a* of the rotary drum 12 the leading end of the printing medium P which has been fed at the same speed as of the circumferential speed of the outer surface 12*a* of the rotary drum 12 from the paired transfer rollers 30 and 32 shown in FIG. 1 to the specific location Y over the outer surface 12*a* of the rotary drum 12.

The rotary drum 12 has a recess 212 therein extending along and in parallel to the center line 14 of rotation of the rotary drum 12 which rotates in the direction X and located just before the particular zone Z on the outer surface 12*a* of the rotary drum 12. The particular zone Z comprises a band-like region at the trailing edge of the recess 212 in the outer surface 12*a* of the rotary drum 12 when the rotary drum 12 is rotated in the direction X. The rotary drum 12 is smaller in radius at the particular zone Z than at the other outer surface 12*a*. As clearly shown, the particular zone Z is located inwardly of a trace 214 of the outer surface 12*a* which extends over the recess 212 from the leading edge to the trailing edge.

A printing medium holding hook 216 is mounted to extend across the recess 212. The printing medium holding hook 216 is integrally formed on one end of a swing member 220 which is pivotably mounted by a pivot pin 218 to the side of the rotary drum 12. As the swing member 220 moves on the pivot, the printing medium holding hook 216 is shifted in a direction opposite to the direction X from the release position spaced forwardly of the direction X from the particular zone Z on the outer surface 12*a* of the rotary drum 12 to the overlap position where the hook 216 comes over the particular zone Z. The other end of the swing member 220 is provided with an engaging pin 222 and a fan-shaped gear sector 224 arranged coaxially of the pivot pin 218.

Also, a sub swing member 228 is pivotably mounted by a pivot pin 226 to the side of the rotary drum 12. The sub swing member 228 is provided at one end with a fan-like gear sector 230 arranged coaxially of the pivot pin 226. The fan-shaped gear sector 230 of the sub swing member 228 is engaged with the fan-shaped gear sector 224 of the swing member 220. The other end of the sub swing member 228 is joined to an urging member 232 which is mounted to the side of the rotary drum 12. By the action of the urging member 232, the printing medium holding hook 216 is urged from the release position, spaced forwardly of the direction X from the particular zone Z on the outer surface 12*a* shown in FIG. 10, towards the overlap position through the engagement between the fan-shaped gear sector 230 of the sub swing member 228 and the fan-shaped gear sector 224 of the swing member 220. The urging member 232 in the embodiment is a tension coil spring.

A cam 234 extending radially of the rotary drum 12 is outwardly mounted to one side of the sub swing member 228.

Also, an engaging lever 238 is pivotably mounted by a pivot pin 236 to the side of the rotary drum 12 as located opposite to the sub swing member 228 about the swing member 220. The engaging lever 238 has an engaging recess 240 provided in one end thereof for engagement with the engaging pin 222 of the swing member 220.

When the printing medium holding hook 216 is at the release position for not holding the leading end of the printing medium P as shown in FIG. 10, the engaging lever 238 is located with its engaging recess 240 engaging the engaging pin 222 of the swing member 220 thus locking the printing medium holding hook 216 to the release position shown in FIG. 10 while resisting against the force of the urging member 232. In other words, the engaging pin 222 of the swing member 220 and the engaging recess 240 of the engaging lever 238 constitute in a combination a release position locking mechanism for locking the printing medium holding hook 216 to the release position.

The engaging lever 238 is also urged to the engaging point by an urging member not shown. The distal end of the printing medium holding hook 216 is situated more outward in the radial direction of the rotary drum 12 at the rearward end in the direction X than at the forward end.

The other end of the engaging lever 238 extends outwardly in the radial direction of the rotary drum 12 thus forming a cam 241.

A lock release mechanism 242 is mounted on the side of the rotary drum 12 for selectively releasing the engagement of the engaging lever 238 just before the printing medium P arrives at the specific location Y over the outer surface 12*a* of the rotary drum 12 which rotates in the direction X. The lock release mechanism 242 comprises a drive lever 246 pivotably mounted by a pivot pin 244 to the housing 10 (FIG. 1) adjacent to the specific location Y and near the side of the rotary drum 12 and a known actuator 248 mounted to the housing 10 (FIG. 1) adjacent to the specific location Y and near the side of the rotary drum 12. The actuator 248 is linked by a link pin 250 to one end of the drive lever 246. The actuator 248 selectively drives the end of the drive lever 246 so that the other end of the drive lever 246 moves between the operating position where it extends and engages with the cam 241 of the engaging lever 238 being turned by the rotation of the rotary drum 12 as shown in FIG. 10 and the rest position which is away from the turning motion of the cam 241. The other end of the drive lever 246 is provided with an engaging pin 251.

Figure 11:
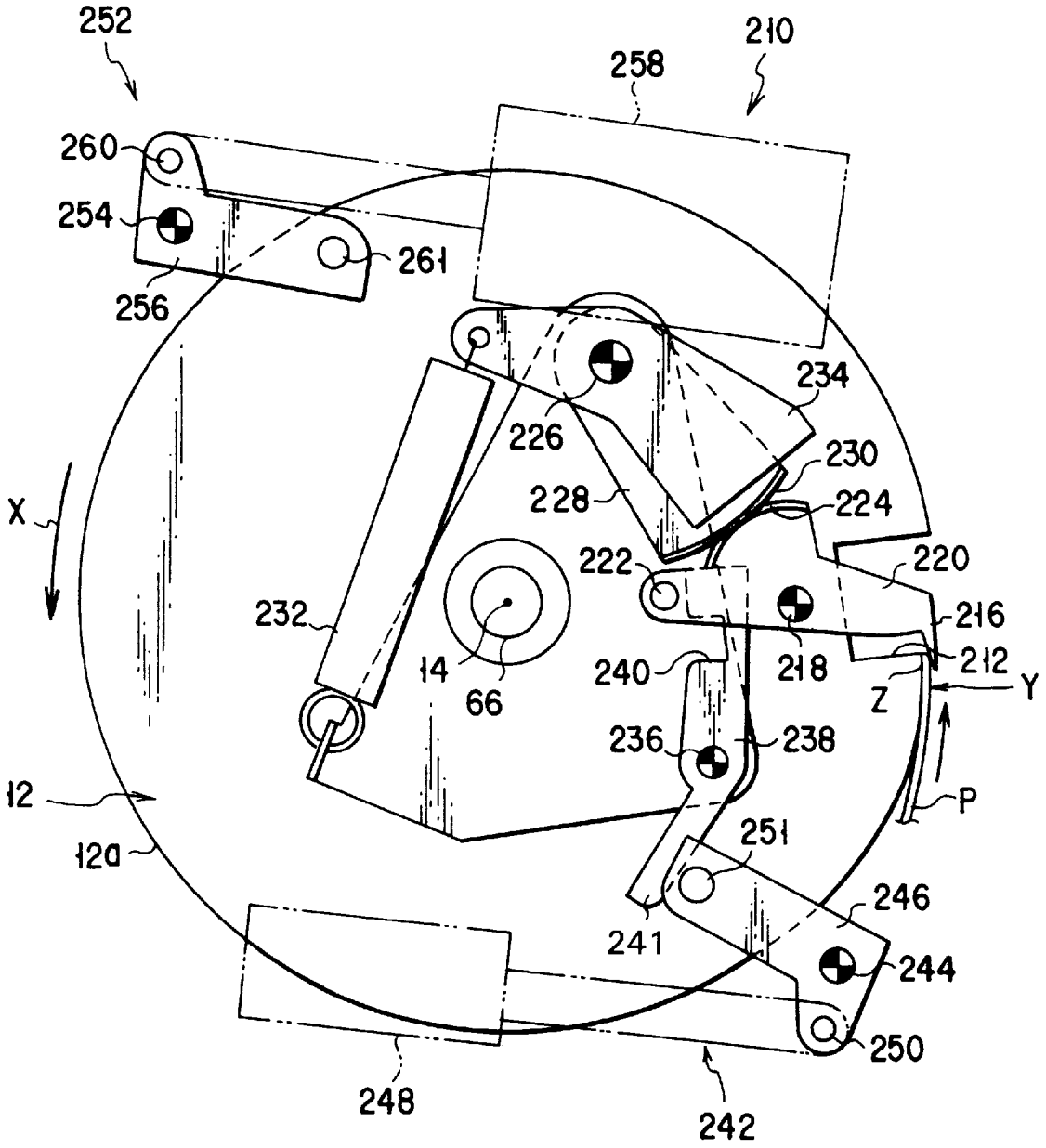
FIG. 11 is an enlarged schematic side view of the printing medium holding device shown in FIG. 10, illustrating a state after holding the leading end of the printing medium.

Moreover, a lock reset mechanism 252 is mounted to the side of the rotary drum 12 for selectively driving the cam 234 joined to the sub swing member 228 to reset the engagement of the engaging lever 238 before reaching the removing device 62 shown in FIG. 1 when the rotary drum 12 rotates in the direction X. The lock reset mechanism 252 is similar in construction to the lock release mechanism 242 and comprises a drive lever 256 pivotably mounted by a pivot pin 254 to the housing 10 (FIG. 1) adjacent to the removing device 62 shown in FIG. 1 and near the side of the rotary drum 12 and a known actuator 258 mounted to the housing 10 (FIG. 1) adjacent to the removing device 62 and near the side of the rotary drum 12. The actuator 258 is linked by a link pin 260 to one end of the drive lever 256. The actuator 258 selectively drives the end of the drive lever 256 so that the other end of the drive lever 256 moves between the operating position where it extends and engages with the cam 234 located at its radially outward position with the sub swing member 228 being turned by the rotation of the rotary drum 12 as shown in FIG. 11 and the rest position which is away from the cam 234 located at its inward position as shown in FIG. 10. The other end of the drive lever 256 is provided with an engaging pin 261.

The actuator 248 of the lock release mechanism 242 drives the drive lever 246 to move to the operating position shown in FIG. 10 before the printing medium holding hook 216 comes to the specific location Y over the outer surface 12*a* of the rotary drum 12 as shown in FIG. 10. With the drive lever 246 at the operating position, the engaging pin 251 on the other end of the drive lever 246 strikes the cam 241 thus turning the engaging lever 238 about the pivot pin 236 in the release direction (clockwisely in FIG. 10) while resisting against the force of the urging member not shown. Accordingly, the swing member 220 is urged by the force of the urging member 232 to move from the release position shown in FIG. 10 to the close position.

In synchronized with the striking of the cam, the printing medium P is fed at the same speed as that of the circumferential speed of the outer surface 12*a* of the rotary drum 12 from the paired transfer rollers 30 and 32 to the specific location Y. Then, the leading end of the printing medium P is pressed against the particular zone Z on the outer surface 12*a* of the rotary drum 12 by the printing medium holding hook 216 at the close position and is held between the particular zone Z and the printing medium holding hook 216 as shown in FIG. 11.

As the rotation of the rotary drum 12 starts, the drive lever 246 is moved backward by the actuator 248 from the operating position shown in FIGS. 10 and 11 to the rest position, not shown, with the printing medium P held by suction to the outer surface 12*a* of the rotary drum 12. This is followed by the number of rotations (four rotations in this embodiment) of the rotary drum 12 required for printing a desired image with the printing equipment 64 shown in FIG. 1.

Figure 12:
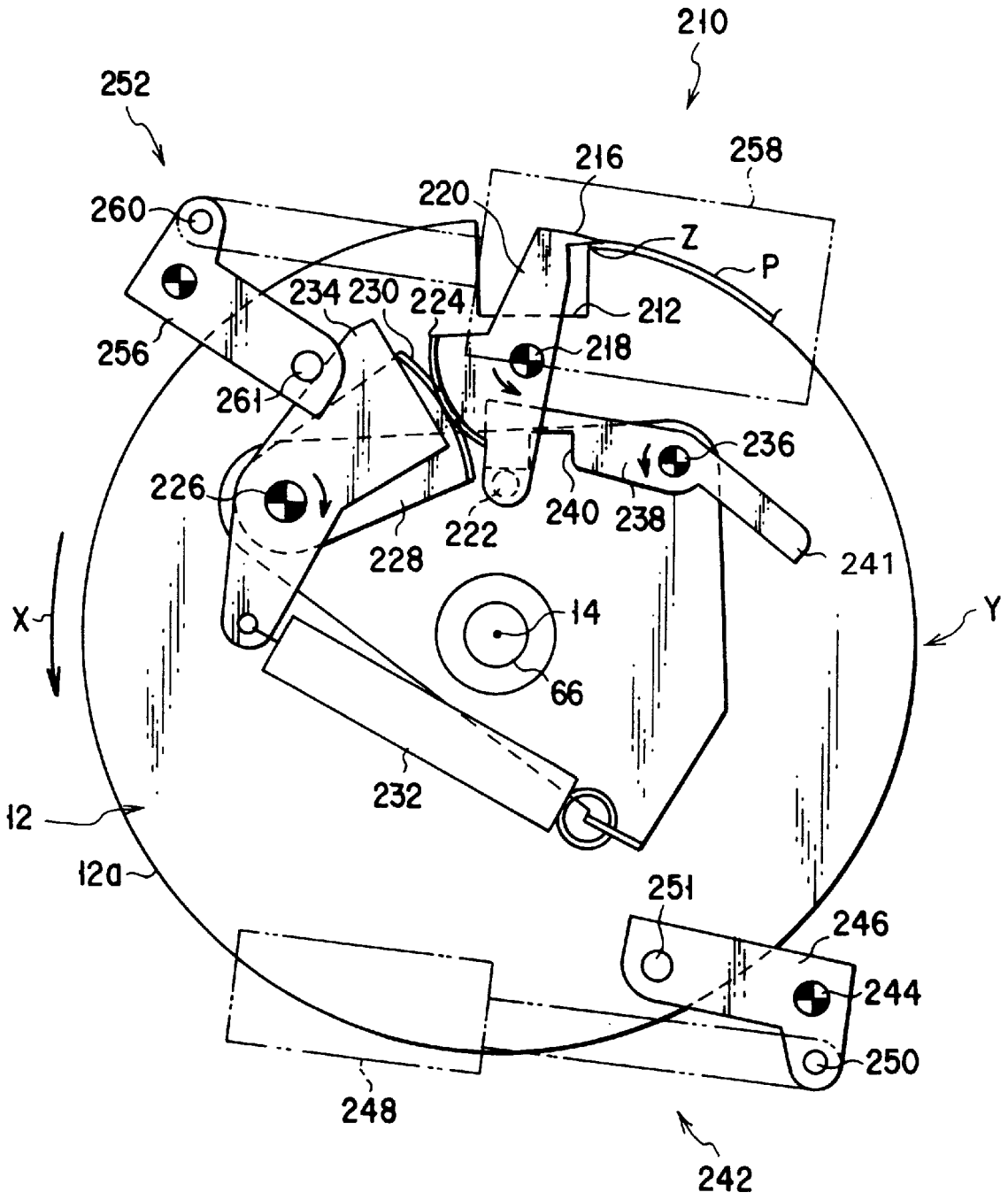
FIG. 12 is an enlarged schematic side view of the printing medium holding device shown in FIG. 10, illustrating a state just before releasing the leading end of the printing medium.

As the rotary drum 12 continues to rotate after the number of rotations, the actuator 258 of the lock reset mechanism 252 drives the drive lever 256 to move forward from the rest position shown in FIGS. 10 and 11 to the operating position shown in FIG. 12 before the printing medium holding hook 216 arrives at the removing device 62 shown in FIG. 1. Then, the cam 234 of the sub swing member 228 which holds the printing medium holding hook 216 to the overlap position strikes the engaging pin 261 on the other end of the drive lever 256 at the operating position. This allows the sub swing member 228 to turn (clockwisely in FIG. 12) from the outward position shown in FIG. 12 to the inward position shown in FIGS. 10 and 11 as resisting against the force of the urging member 232, hence shifting the printing medium holding hook 216 from the close position to the open position. The engaging pin 222 of the swing member 220 having the printing medium holding hook 216 is then engaged with the engaging recess 240 provided in the engaging lever 238 urged by the urging member, not shown. Finally, the printing medium holding hook 216 is locked to the open position while resisting against the force of the urging member 232.

As the rotary drum 12 further rotates, the printing medium P held at the particular zone on the outer surface 12*a* of the rotary drum 12 is removed by the removing device 62 from the particular zone shown in FIG. 1. To print the image on the succeeding printing medium P, the rotary drum 12 starts again the foregoing procedure described in detail referring to FIGS. 10 and 11.

[First Modification]

Figure 13:
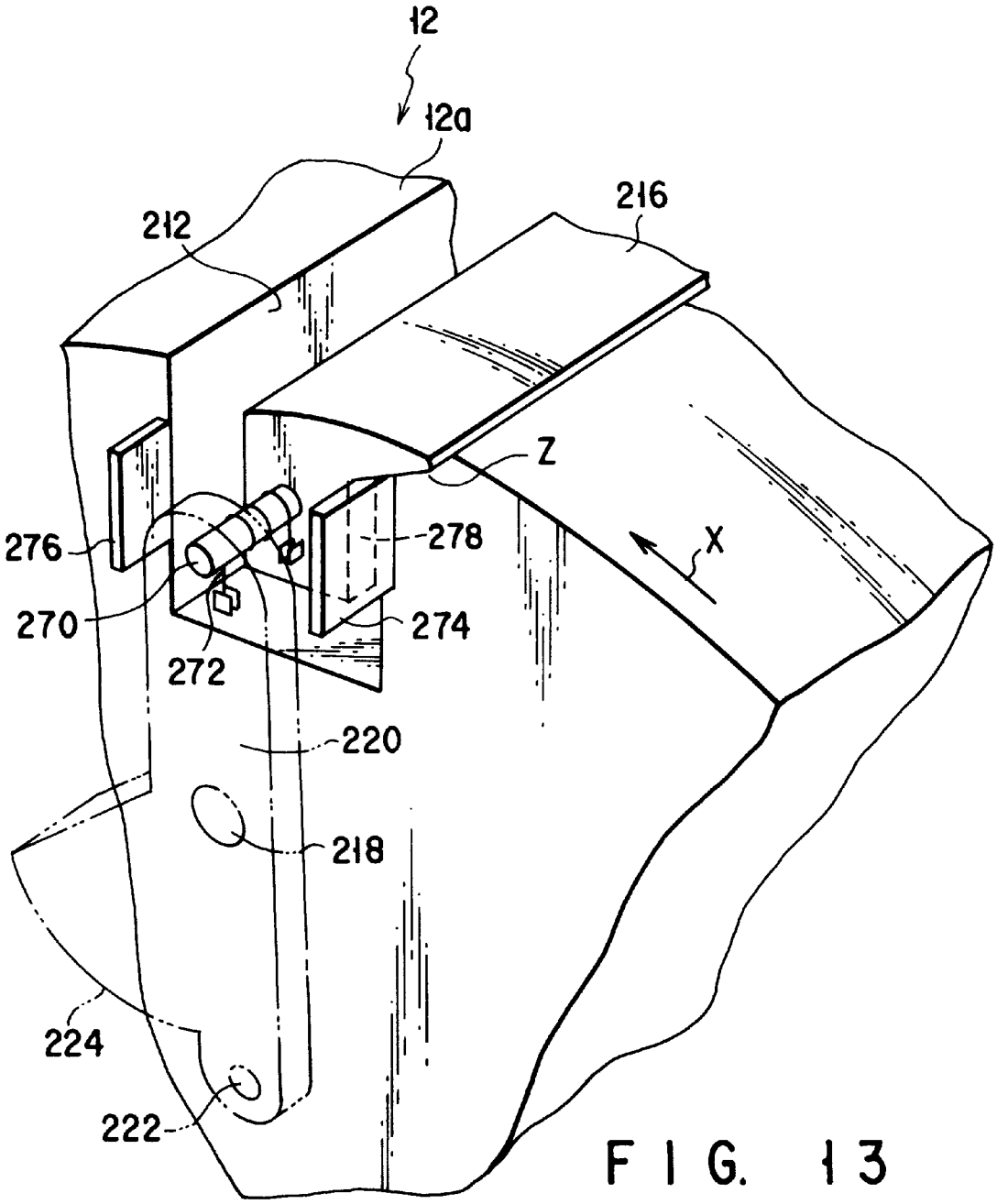
FIG. 13 is an enlarged schematic perspective view illustrating a first modification of the printing medium holding device shown in FIG. 10.

FIG. 13 schematically illustrates a first modification of the printing medium holding device 210 shown in FIG. 10. In the first modification, like components identical to those of the printing medium holding device 210 shown in FIG. 10 are denoted by like numerals and will be explained in no more detail.

The first modification is differentiated from the printing medium holding device 210 shown in FIG. 10 by the fact that the printing medium holding hook 216 is joined by a pivot pin 270 to the end of the swing member 220 so that it pivotably moves between the close position over the particular zone Z on the outer surface 12*a* of the rotary drum 12 and the open position. The swing member 220 functions as a hook support for holding the printing medium holding hook 216 for pivotal movement between the close position and the open position.

The printing medium holding hook 216 in the first modification is urged towards the open position by an urging member 272 such as a coil spring mounted at the other end to the swing member 220. A pair of engaging members 274 and 276 are provided at both, forward and rearward, ends of the recess 212 extending outwardly from the side of the rotary drum 12. The printing medium holding hook 216 has a cam 278 provided on a projection thereof inwardly along the radial direction of the rotary drum 12, the projection extending off the recess 212.

Figure 14:
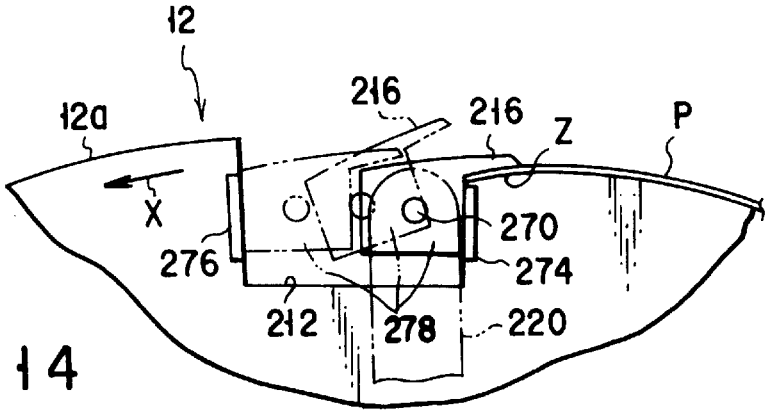
FIG. 14 is a schematic side view illustrating an action of the first modification shown in FIG. 13.

The cam 278 of the printing medium holding hook 216 comes into direct contact with the engaging member 276 at the forward end as denoted by the two-dot chain line in FIG. 14 when the swing member 220 is urged by the engaging lever 238 at the engaging position shown in FIG. 10 so that its end is close to the forward end of the recess 212 with the printing medium holding hook 216 dislocated in the direction X from the particular zone Z on the outer surface 12*a* of the rotary drum 12. This allows the printing medium holding hook 216 to stay within the recess 212 so that its rearward end along the direction X of the rotary drum 12 does not extend outward in the radial direction of the rotary drum 12 as if it is at the close position and resists against the force of the urging member 272 as denoted by the two-dot chain line in FIG. 14. Accordingly, the printing medium holding hook 216 is prevented from extending outwardly from the recess 212 in the radial direction of the rotary drum 12.

When the engagement between the swing member 220 and the engaging lever 238 shown in FIG. 10 is released and the swing member 220 is moved in the direction opposite to the direction X towards the rearward end of the recess 212 by the force of the urging member 232 (FIG. 10), the printing medium holding hook 216 arrives at the particular zone Z on the outer surface 12*a* of the rotary drum 12 and its cam 278 is set free between the paired engaging members 274 and 276. The printing medium holding hook 216 is thus projected outwardly from the rotary drum 12 with the rearward end defined in the direction X higher than the forward end as denoted by the two-dot chain line in FIG. 14.

The projection of the rearward end is greater than that of the printing medium holding hook 216 at the release position in the previous embodiment shown in FIG. 10. As compared with the previous embodiment, the first modification permits the leading end of the printing medium P to be held with much ease by the printing medium holding hook 216 moving from the open position to the close or overlap position at the particular zone Z.

Before the swing member 220 driven on the pivot by the force of the urging member 232 (FIG. 10) reaches the rearward end of the recess 212 or the printing medium holding hook 216 arrives at the particular zone Z on the outer surface 12*a* of the rotary drum 12, the cam 278 on the printing medium holding hook 216 comes into direct contact with the engaging member 274 at the rearward end as denoted by the solid line in FIGS. 13 and 14. This allows the printing medium holding hook 216 to be forcedly or securely locked to the close position over the particular zone Z on the outer surface 12*a* of the rotary drum 12, as denoted by the real line in FIGS. 13 and 14, while resisting against the force of the urging member 272.

To shift the printing medium holding hook 216 from the close position shown in FIG. 12 to the open position, the swing member 220 is turned counter-clockwisely as resisting against the force of the urging member 232 by the action of the lock reset mechanism 252, as shown in FIGS. 13 and 14, and its end moves from the rearward end to the forward end of the recess 212. As the printing medium holding hook 216 has departed from the particular zone Z on the outer surface 12*a* of the rotary drum 12 in the direction X of rotation, it travels from the close position denoted by the solid line in FIGS. 13 and 14 via the projecting position denoted on the right by the two-dot chain line in FIG. 14 to the open position denoted on the left by the two-dot chain line in FIG. 14 where it rests horizontally.

Figure 15:
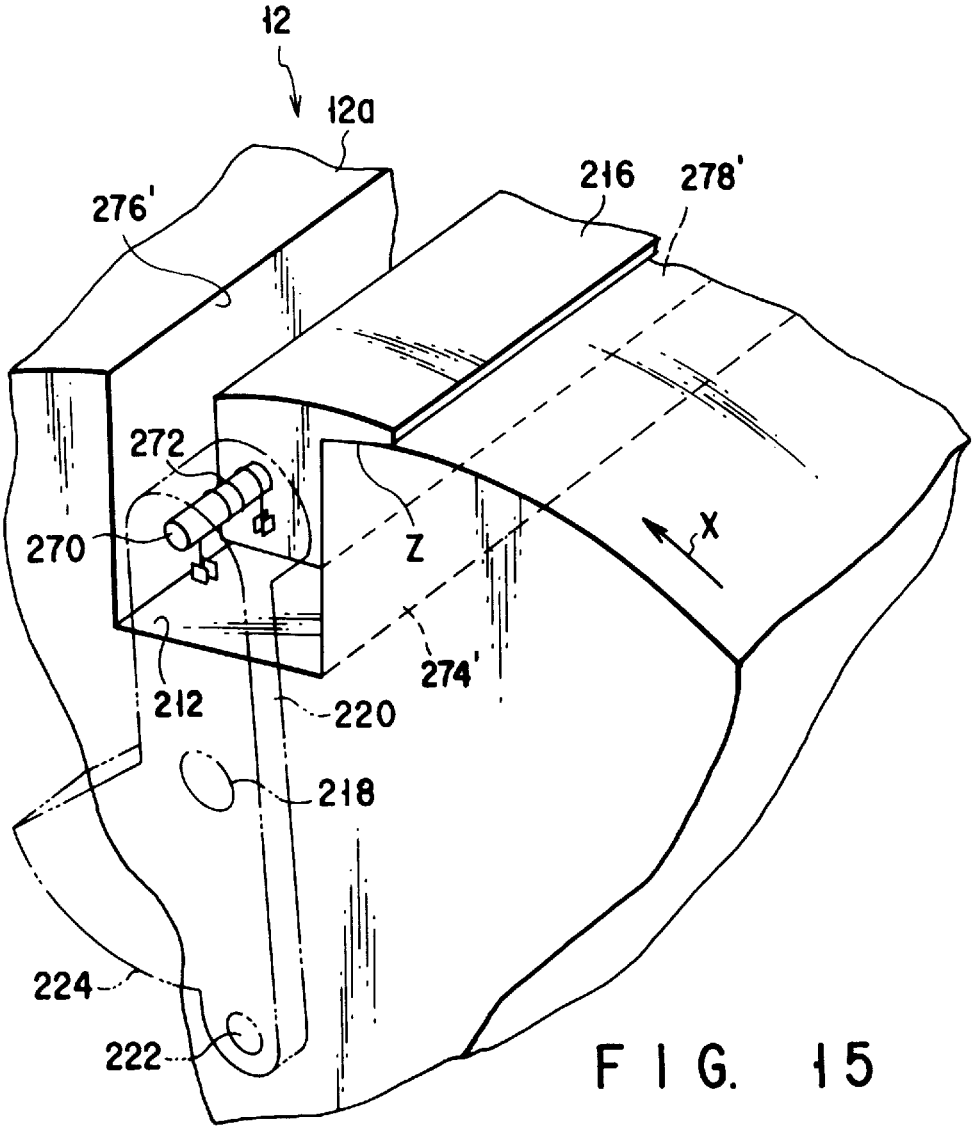
FIG. 15 is an enlarged schematic perspective view illustrating a minor alternative of the first modification shown in FIG. 13.

FIG. 15 is an enlarged perspective view schematically showing a minor change of the first modification of FIG. 13. In this minor change, in place of the paired engaging members 274, 276 shown in FIGS. 13 and 14, the front end surface 276' and the rear end surface 274' are used as the engaging members, and the can member 278' in projected inwardly in the recess 212 from the holding hook 216 in the radial direction of the rotary drum 12. Therefore, the structure of the minor change is more simple and more compact than that of the first modification.

[Second Modification]

Figure 16A:
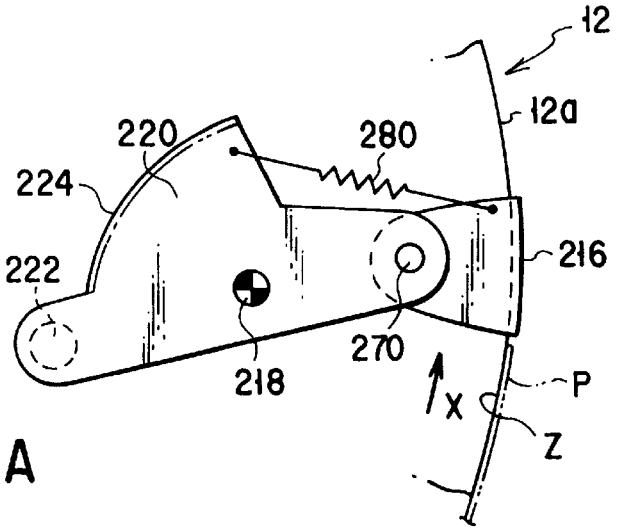
FIG. 16A is a schematic side view of a second modification of the printing medium holding device in which a printing medium holding hook is located at the close position.

FIG. 16A schematically illustrates a second modification of the printing medium holding device 210 shown in FIG. 10. In the second modification, like components identical to those of the printing medium holding device 210 shown in FIG. 10 are denoted by like numerals and will be explained in no more detail.

The second modification is differentiated from the printing medium holding device 210 shown in FIG. 10 by the fact that the printing medium holding hook 216 is joined by a pivot pin 270 to the end of the swing member 220 for pivotal movement between the close position at the particular zone Z on the outer surface 12*a* of the rotary drum 12 and the open position. The swing member 220 functions as a hook support for holding the printing medium holding hook 216 in its pivotal movement between the close position and the open position.

There is no recess provided next to the particular zone Z on the outer surface 12*a* of the rotary drum 12 for accepting the printing medium holding hook 216 at the open or away position.

The printing medium holding hook 216 is urged towards the close position by an urging member 280 mounted at the other end to the swing member 220. The urging member 280 in this modification is a tension coil spring mounted between a portion of the printing medium holding hook 216 near to its front end and a portion of the other end of the swing member 220 near to its front end.

The printing medium holding hook 216 is placed over the particular zone Z on the outer surface 12*a* of the rotary drum 12 as if it is at the close position while resisting against the force of the urging member 280, as shown in FIG. 16A, when the swing member 220 is held by the engaging lever 238 at the engaging position shown in FIG. 10 so that its end is distanced together with the printing medium holding hook 216 in the direction X from the particular zone Z on the outer surface 12*a* of the rotary drum 12. This allows the rearward end of the printing medium holding hook 216 defined along the direction X of the rotary drum 12 not to extend outward in the radial direction of the rotary drum 12.

Figure 16B:
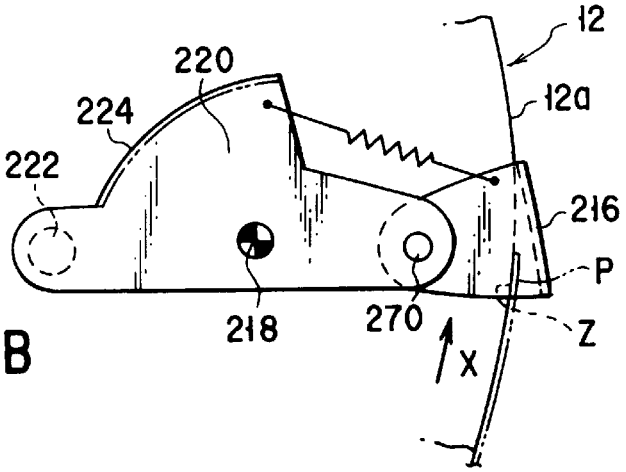
FIG. 16B is a schematic side view illustrating the printing medium holding hook of the second modification shown in FIG. 16A shifted from the close position shown in FIG. 16A to the open position before holding the leading end of the printing medium.

When the engagement between the swing member 220 and the engaging lever 238 shown in FIG. 10 is released and the swing member 220 is moved from the position shown in FIG. 10 towards the particular zone Z in the direction opposite to the direction X by the force of the urging member 232 (FIG. 10), the printing medium holding hook 216 travels around the forward end with its rearward end projecting radially outwardly from the outer surface 12*a* of the rotary drum 12, as shown in FIG. 16B. The projection of the rearward end is greater than that of the printing medium holding hook 216 at the release position in the previous embodiment shown in FIG. 10. As compared with the previous embodiment, the second modification permits the leading end of the printing medium P to be held with much ease by the printing medium holding hook 216 moving from the open position away from the particular zone Z to the close or overlap position at the particular zone Z.

Figure 16C:
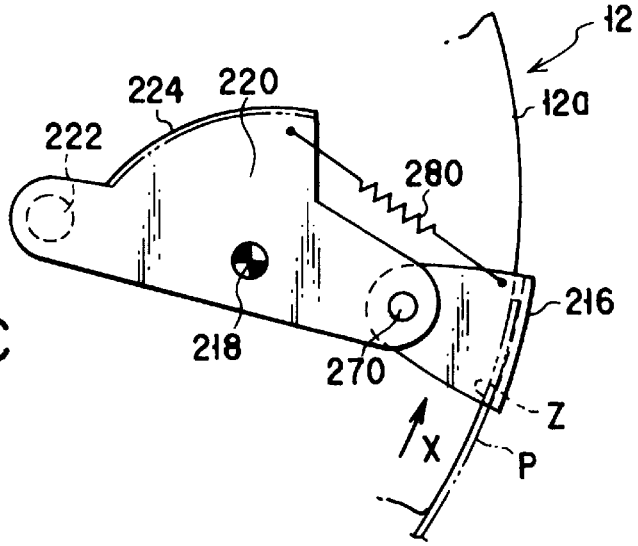
FIG. 16C is a schematic side view illustrating the printing medium holding hook of the second modification shown in FIG. 16A shifted from the open position shown in FIG. 16B to the close position for holding the leading end of the printing medium.

Before the swing member 220 driven on the pivot by the force of the urging member 232 (FIG. 10) arrives at the particular zone Z on the outer surface 12*a* of the rotary drum 12, the printing medium holding hook 216 comes to the close position over the particular zone Z on the outer surface 12*a* of the rotary drum 12 as shown in FIG. 16C while resisting against the force of the urging member 280 thus being locked forcedly or securely.

To shift the printing medium holding hook 216 from the overlap or close position shown in FIG. 16C to the away position shown in FIG. 16A, the swing member 220 is turned counter-clockwisely as resisting against the force of the urging member 232 by the action of the lock reset mechanism 252, as shown in FIG. 12, and its end departs with the printing medium holding hook 216 from the particular point Z on the outer surface 12*a* of the rotary drum 12 in the direction X of rotation. Hence, the printing medium holding hook 216 travels from the overlap or close position shown in FIG. 16C via the projecting position shown in FIG. 16B to the away position shown in FIG. 16A which is distanced from the close position.

[Third Modification]

Figure 17A:
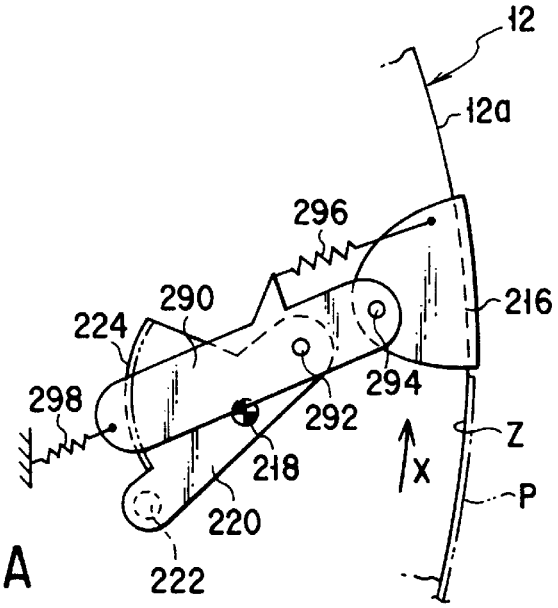
FIG. 17A is a schematic side view of a third modification of the printing medium holding device shown in FIG. 10 in which the printing medium holding hook is located at the close position.

FIG. 17A schematically illustrates a third modification of the printing medium holding device 210 shown in FIG. 10. In the third modification, like components identical to those of the printing medium holding device 210 shown in FIG. 10 are denoted by like numerals and will be explained in no more detail.

The third modification is differentiated from the printing medium holding device 210 shown in FIG. 10 by the fact that the printing medium holding hook 216 is joined by a pivot pin 294 to an intermediate lever 290 which is linked by a pivot pin 292 to the end of the swing member 220. The pivot pin 292 on the intermediate lever 290 is located closer to the outer surface 12*a* of the rotary drum 12 than the pivot pin 218 on the swing member 220. The pivot pin 294 on the printing medium holding hook 216 is located closer to the outer surface 12*a* of the rotary drum 12 than the pivot pin 292 on the intermediate lever 290.

The swing member 220 functions as a hook support for holding the printing medium holding hook 216 in its pivotal movement on the intermediate lever 290 between the close position and the open position.

In this modification, there is no recess provided next to the particular zone Z on the outer surface 12*a* of the rotary drum 12 for accepting the printing medium holding hook 216 at the open or away position.

The printing medium holding hook 216 is urged towards the close position by an urging member 296 mounted at the other end to the intermediate lever 290. The urging member 296 in this modification is a tension coil spring mounted between a portion of the printing medium holding hook 216 near to its front end and a portion of the intermediate lever 290 near to its front end. The intermediate lever 290 is also urged radially and inwardly of the rotary drum 12 by an urging member 298 mounted at the other end to the side of the rotary drum 12. Also, the urging member 298 is a tension coil spring mounted between the other end or radially inward end of the intermediate lever 290 and the side of the rotary drum 12.

The printing medium holding hook 216 is placed over the particular zone Z on the outer surface 12*a* of the rotary drum 12 as if it is at the close position while resisting against the force of the urging member 296, as shown in FIG. 17A, when the swing member 220 is held by the engaging lever 238 at the engaging position shown in FIG. 10 so that its end is distanced together with the printing medium holding hook 216 in the direction X from the particular zone Z on the outer surface 12*a* of the rotary drum 12. This allows the rearward end of the printing medium holding hook 216 defined along the direction X of the rotary drum 12 not to extend outwardly in the radial direction of the rotary drum 12.

Figure 17B:
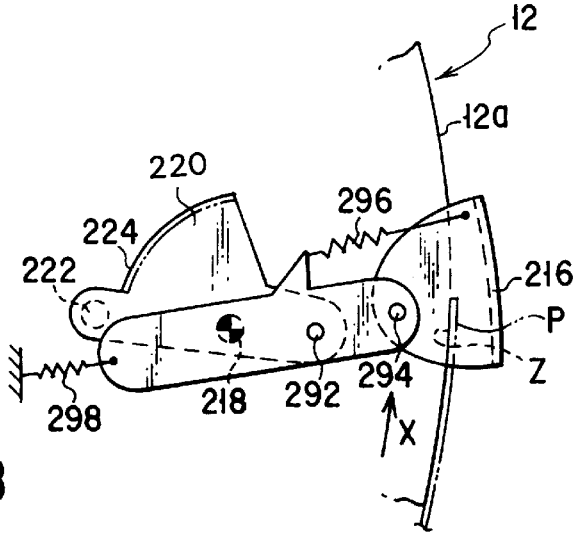
FIG. 17B is a schematic side view illustrating the printing medium holding hook of the third modification shown in FIG. 17A shifted from the close position shown in FIG. 17A to the open position before holding the leading end of the printing medium.

When the engagement between the swing member 220 and the engaging lever 238 shown in FIG. 10 is released and the swing member 220 is moved from the position shown in FIG. 10 towards the particular zone Z in the opposite direction of the direction X by the force of the urging member 232 (FIG. 10), the printing medium holding hook 216 with the intermediate lever 290 travels around its forward end with its rearward end projecting radially outwardly from the outer surface 12*a* of the rotary drum 12, as shown in FIG. 17B. The projection of the rearward end is greater than that of the printing medium holding hook 216 at the release position in the previous embodiment shown in FIG. 10. As compared with the previous embodiment and the second modification shown in FIGS. 16A to 16C, the third modification permits the leading end of the printing medium P to be held with much ease by the printing medium holding hook 216 moving from the open position away from the particular zone Z to the close or overlap position at the particular zone Z.

Figure 17C:
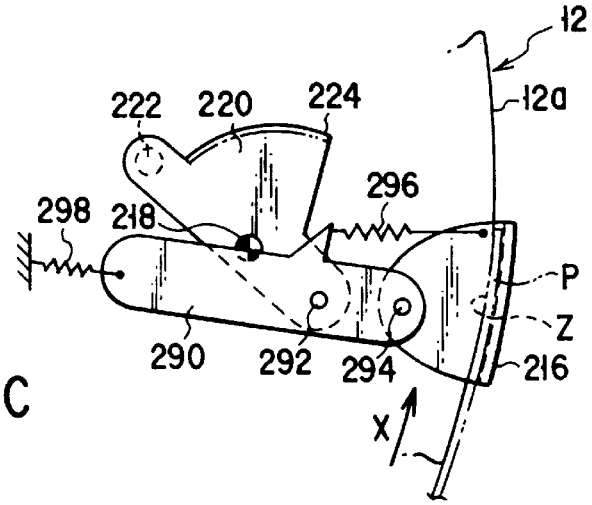
FIG. 17C is a schematic side view illustrating the printing medium holding hook of the third modification shown in FIG. 17A shifted from the open position shown in FIG. 17B to the close position for holding the leading end of the printing medium.

Before the swing member 220 driven on the pivot by the force of the urging member 232 (FIG. 10) arrives at the particular zone Z on the outer surface 12*a* of the rotary drum 12 together with the printing medium holding hook 216 and the intermediate lever 290, the printing medium holding hook 216 comes to the close position over the particular point Z on the outer surface 12*a* of the rotary drum 12 as shown in FIG. 17C while resisting against the force of the urging member 296 thus being locked forcedly or securely.

To shift the printing medium holding hook 216 from the overlap or close position shown in FIG. 17C to the away position shown in FIG. 17A, the swing member 220 is turned counter-clockwisely as resisting against the force of the urging member 232 by the action of the lock reset mechanism 252, as shown in FIG. 12, and its end departs with the printing medium holding hook 216 from the particular zone Z on the outer surface 12*a* of the rotary drum 12 in the direction X of rotation. Hence, the printing medium holding hook 216 travels from the overlap or close position shown in FIG. 17C via the projecting position shown in FIG. 17B to the away position shown in FIG. 17A which is distanced from the close position.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. Apparatus for holding a printing medium on a rotary drum, comprising:

a rotary drum having a center line of rotation thereof and an outer surface arranged substantially concentric with the center line of rotation, and a recess provided in the outer surface which extends along the center line of rotation, the rotary drum being driven for rotation about the center line of rotation at a predetermined speed, and a region of the outer surface of the rotary drum adjacent to a rearward end of the recess in the direction of the rotation of the rotary drum being smaller in diameter than the remaining region of the outer surface;

a printing medium suction device mounted to the rotary drum to hold the printing medium fed toward the rotary drum onto the outer surface of the rotary drum;

a printing medium holding mechanism having a printing medium holding hook located in the recess and mounted to the rotary drum to selectively drive the printing medium holding hook between a close position and an open position, in the close position the printing medium holding hook being placed on the recess rearward end adjacent region of the outer surface of the rotary drum so as not to project radially outwardly from the remaining region of the outer surface, and in the open position the printing medium holding hook being separated from the recess rearward end adjacent region of the outer surface, the printing medium holding hook being driven by the printing medium holding mechanism to be moved from its open position to its close position when the leading end of the printing medium fed toward the rotary drum arrives at the recess rearward end adjacent region of the outer surface of the rotary drum, so as to hold the leading end of the printing medium in cooperation with the recess rearward end adjacent region of the outer surface, and the printing medium holding hook being driven by the printing medium holding mechanism to be moved from its close position to its open position when the rotary drum has conducted a specific number of rotations; and a printing medium removing mechanism which removes the printing medium from the outer surface of the rotary drum when the rotary drum has conducted the specific number of rotations and the printing medium holding hook of the printing medium holding mechanism has moved from the close position to the open position.

2. The apparatus according to claim 1, wherein, at the open position, the printing medium holding hook of the printing medium holding mechanism having its rearward end positioned opposite to the direction of rotation of the rotary drum so as to project radially outwardly from the remaining region of the outer surface of the rotary drum, and the printing medium holding hook having its forward end in the direction of rotation of the rotary drum so as to be radially more inner than the rearward end.

3. The apparatus according to claim 2, wherein the printing medium holding mechanism supports the printing medium holding hook enabling the printing medium holding hook to pivot in two directions, in one direction the printing medium holding hook moving toward the outer surface of the rotary drum, and in the other direction the printing medium holding hook moving away from the outer surface of the rotary drum, the printing medium holding mechanism further comprising an urging member for urging the printing medium holding hook in an other direction, and a forcedly turning mechanism for turning the printing medium holding hook forcedly in the one direction against the urging force of the urging member when the printing medium holding hook is moved from the open position to the close position just before arriving at the close position.

4. The apparatus according to claim 1, wherein the printing medium holding mechanism comprises:

a swing member having a distal end including the printing medium holding hook, supported by at least one of the two side surfaces of the rotary drum to make a pivotal movement in response to the movement of the printing medium holding hook between the close position and the open position;

an urging member mounted to at least one of the two side surfaces of the rotary drum which urges the swing member to move the printing medium holding hook to the close position; and a swing member operating device which corresponds to the at least one of the two side surfaces of the rotary drum and holds the swing member to keep the printing medium holding hook in the open position against the urging force of the urging member, from just before the printing medium is removed by the printing medium removing mechanism from the outer surface of the rotary drum after the rotary drum holding the printing medium thereon has conducted the specific number of rotations, to just before the leading end of a next printing medium supplied toward the outer surface of the rotary drum is held by a combination of the printing medium holding hook of the printing medium holding mechanism with the region of the outer surface of the rotary drum adjacent to the rearward end of the recess in the direction of the rotation of the rotary drum.

5. The apparatus according to claim 4, wherein the printing medium holding mechanism includes a sub swing member mounted to at least one of the two side surfaces of the rotary drum so as to be pivotable in response to the pivotal movement of the swing member, the swing member operating device including a drive member and an actuator, the drive member being movable between a rest position in which the drive member is out of the trace of the sub swing member of the printing medium holding mechanism during when the rotary drum rotates with the printing medium holding hook being located at the close position, and an action position in which the drive member projects into the trace, the actuator selectively moving the drive member between the rest position and the action position, and the drive member being selectively driven by the actuator to move from the rest position to the action position striking the sub swing member so that the sub swing member drives the swing member against the urging force of the urging member to move the printing medium holding hook from the close position to the open position.

6. The apparatus according to claim 4, wherein the printing medium holding mechanism includes an open position lock mechanism which locks the swing member having driven the printing medium holding hook to the open position, against the urging force of the urging member, and a lock release mechanism which releases the locking of the swing member with the open position lock mechanism when the leading end of the printing medium fed toward the rotary drum arrives at the recess rearward end adjacent region of the outer surface of the rotary drum.

7. The apparatus according to claim 6, wherein the printing medium holding mechanism includes a sub swing member mounted to the at least one of the two side surfaces of the rotary drum so as to be pivotable in response to the pivotal movement of the swing member, the swing member operating device including a drive member and an actuator, the drive member being movable between a rest position in which the drive member is out of the trace of the sub swing member of the printing medium holding mechanism when the rotary drum rotates with the printing medium holding hook being located at the close position, and an action position in which the drive member projects into the trace, the actuator selectively moving the drive member between the rest position and the action position, and the drive member being driven by the actuator to move from the rest position to the action position striking the sub swing member so that the sub swing member drives the swing member against the urging force of the urging member to move the printing medium holding hook from the close position to the open position.

8. An apparatus according to claim 6, wherein the open position lock mechanism includes:

an engaging member mounted to the at least one of the two side surfaces of the rotary drum to make a pivotal movement between an engaging position in which the engaging member engages and locks the swing member which has driven the printing medium holding hook to the open position, and a disengaging position in which the engaging member disengages from and allows the swing member to be pivotable by the urging force of the urging member so as to move the printing medium holding hook from the open position to the close position, the engaging member being urged toward the engaging position;

the lock release mechanism includes a drive member and an actuator, the drive member being movable between a rest position in which the drive member is out of the trace of the engaging member of the open position lock mechanism when the rotary drum rotates with the engaging member being located at the engaging position, and an action position in which the drive member projects into the trace of the engaging member, the actuator selectively moving the drive member between the rest position and the action position, and the drive member being driven by the actuator to move from the rest position to the action position striking the engaging member of the open position lock mechanism so that the engaging member moves from the engaging position to the disengaging position against the urging force of the urging member.

9. An ink jet printer employing the apparatus according to claim 1, further comprising:

a printing medium feeding device which feeds the printing medium onto the outer surface of the rotary drum at a speed corresponding to a peripheral speed of the rotary drum; and at least one printing head disposed along the outer surface of the rotary drum to extend in parallel to the center line of rotation being supplied with an image signal, the at least one printing head having a plurality of ink jet nozzles provided to face the outer surface of the rotary drum and to align in parallel with the center line of rotation, and applying ink jets of at least one color to the printing medium to print an image according to the image signal on the printing medium while the rotary drum on which the printing medium is held conducts the specific number of rotations.

10. The ink jet printer according to claim 9, wherein a plurality of printing heads are mounted separate from each other along the outer surface of the rotary drum and are supplied with image signals, each printing head extending in parallel to the center line of rotation and having a plurality of ink jet nozzles provided to face the outer surface of the rotary drum and to align in parallel with respect to the center line of rotation, so that the printing heads apply ink jets of different colors to the printing medium to print a full color image according to the image signals on the printing medium while the rotary drum conducts the specific number of rotations.

11. The ink jet printer according to claim 9, further comprising a printing medium discharging device which conveys the printing medium removed from the outer surface of the rotary drum away from the rotary drum at least at a speed corresponding to the peripheral speed of the rotary drum.

12. An ink jet printer employing the apparatus according to claim 1, comprising:

a plurality of nozzle units corresponding to a plurality of ink colors arranged around the outer surface of the rotary drum along the rotation direction of the rotary drum, each nozzle unit having a plurality of ink jet nozzles arranged at equal intervals in a direction along the center line of rotation of the rotary drum; and an axially reciprocating mechanism which reciprocates the nozzle units in a direction along the center line of rotation of the rotary drum, the axially reciprocating mechanism moving the plurality of nozzle units by 1/N of an ink jet nozzle pitch PT at each rotation of the rotary drum and performing a color printing on the printing medium in a density that is N times in a density defined by the ink jet nozzle pitch PT, by using N times rotation of the rotary drum.

13. The printer according to claim 12, wherein the plurality of nozzle units are arranged so that the plurality of ink jet nozzles of each of the nozzle units are aligned in the direction along the center line of rotation of the rotary drum.

14. The printer according to claim 12, wherein the axially reciprocating mechanism includes a bi-directional motor unit having an output shaft which can reciprocate in a direction along a rotational center line thereof by changing a rotational direction thereof.

15. The printer according to claim 14, wherein the motor unit is a rotation speed changeable type and is provided with a controller unit which controls an operation of the motor unit to make the motor unit move the output shaft forward while the printer is performing full color printing and to make the motor unit move the output shaft backward at a higher speed after the printer has performed the full color printing than that of the forward movement of the output shaft.

16. Apparatus for holding a printing medium on a rotary drum, comprising:

a rotary drum having a center line of rotation thereof and an outer surface arranged substantially concentric with the center line of rotation, the rotary drum rotating at a predetermined speed about the center line of rotation;

a printing medium suction device mounted to the rotary drum to hold the printing medium fed toward the outer surface of the rotary drum by a printing medium feeding device onto the outer surface of the rotary drum;

a printing medium holding mechanism having a printing medium holding hook located on the outer surface and mounted to the rotary drum to selectively drive the printing medium holding hook between a close position and an open position, in the close position the printing medium holding hook being placed on the outer surface, and in the open position the printing medium holding hook being spaced away from the outer surface, the printing medium holding hook in the open position being moved from the open position to the close position to hold a leading end of the printing medium fed toward the outer surface of the rotary drum with the outer surface of the rotary drum when the leading end of the printing medium arrives at a position on the outer surface of the rotary drum, on which the printing medium holding hook at the closed position is placed, the printing medium holding hook holding the leading end of the printing medium with the outer surface of the rotary drum, being returned from the close position to the open position when the rotary drum has conducted a specific number of rotations; and a printing medium removing mechanism which removes the printing medium from the outer surface of the rotary drum when the rotary drum has conducted the specific number of rotations, wherein the printing medium holding mechanism comprises:

a hook holding member having an urging member as well as the printing medium holding hook and being mounted to at least one of two side surfaces of the rotary drum to urge the printing medium holding hook to the close position by the force of the urging member;

a hook holding member operating device which is provided in relation to the at least one of the two side surfaces of the rotary drum and operating the hook holding member to move the hook holding member against an urging force of the urging member from the close position to the open position at two timings, one of which is just before the leading end of the printing medium which is fed toward the outer surface of the rotary drum is held between the printing medium holding hook of the printing medium holding mechanism and the outer surface of the rotary drum, and the other of which is just before the printing medium is removed by the printing medium removing mechanism from the outer surface of the rotary drum when the rotary drum with the printing medium has conducted the specific number of rotations;

an open position lock mechanism mounted to at least one of the two side surfaces of the rotary drum and locking the hook holding member against the urging force of the urging member when the printing medium holding hook has been moved to the open position; and a lock release mechanism provided in relation to the at least one of the two side surfaces of the rotary drum, having an actuator being actuated when the printing medium holding hook is located at the open position and the leading end of the printing medium fed toward the outer surface of the rotary drum arrives at a position of the outer surface of the rotary drum on which the printing medium holding hook is placed when it is at the close position, in which the locking of the hook holding member with the open position lock mechanism is released by the actuator.

17. The apparatus according to claim 16, wherein the rotary drum has a recess extending along the center line of rotation in the outer surface of the rotary drum, a region of the outer surface of the rotary drum adjacent to a rearward end of the recess in a direction of rotation of the rotary drum is smaller in diameter than the remaining region of the outer surface, the printing medium holding hook of the printing medium holding mechanism being accommodated in the recess, the printing medium holding hook being prevented from radially outwardly projecting from the remaining region of the outer surface when the printing medium holding hook is located at the close position and is placed on the region of the outer surface adjacent to the rearward end of the recess, and the printing medium holding hook moved from the open position to the close position pinches and holds the leading end of the printing medium fed toward the outer surface of the rotary drum with the region of the outer surface of the rotary drum being adjacent to the rearward end of the recess.

18. The apparatus according to claim 17, wherein, at the open position, the printing medium holding hook of the printing medium holding mechanism making its rearward end located opposite to the direction of rotation of the rotary drum project radially outwardly from the remaining region of the outer surface of the rotary drum, and making its forward end in the direction of rotation of the rotary drum stay radially more inner than the rearward end.

19. The apparatus according to claim 18, wherein the hook holding member of the printing medium holding mechanism supports the printing medium holding hook to allow the printing medium holding hook to pivot in two directions, in one direction the printing medium holding hook moving toward the outer surface of the rotary drum, and in the other direction the printing medium holding hook moving away from the outer surface of the rotary drum, and the printing medium holding mechanism further includes an urging member for urging the printing medium holding hook in the other direction and a forcedly turning mechanism for turning the printing medium holding hook forcedly in the one direction against the urging force of the urging member when the printing medium holding hook is moved from the open position to the close position and just before arriving at the close position.

20. The apparatus according to claim 17, wherein the hook holding member of the printing medium holding mechanism has a swing member pivotably mounted to at least one of the side surfaces of the rotary drum and including a distal end having the printing medium holding hook, and wherein the printing medium holding mechanism comprises:

a sub swing member mounted to the at least one of the side surfaces of the rotary drum so as to be pivotable in response to the pivotal movement of the swing member;

an urging member mounted to at least one of the two side surfaces of the rotary drum which urges the swing member to move the printing medium holding hook to the close position; and a swing member operating device provided to correspond to the at least one of the two side surfaces of the rotary drum and holding the swing member to keep the printing medium holding hook in the open position against the urging force of the urging member, from just before the printing medium is removed by the printing medium removing mechanism from the outer surface of the rotary drum after the rotary drum holding the printing medium thereon has conducted the specific number of rotations, to just before the leading end of a next printing medium supplied toward the outer surface of the rotary drum is held by a combination of the printing medium holding hook of the printing medium holding mechanism with the region of the outer surface of the rotary drum adjacent to the rearward end of the recess in the direction of the rotation of the rotary drum, wherein the swing member operating device includes a drive member and an actuator, wherein the drive member is movable between a rest position in which the drive member is out of the trace of the sub swing member of the printing medium holding mechanism when the rotary drum rotates with the printing medium holding hook being located at the close position, and an action position in which the drive member projects into the trace, and wherein the actuator selectively moves the drive member between the rest position and the action position, and the drive member being driven by the actuator to move from the rest position to the action position, striking the sub swing member so that the sub swing member drives the swing member against the urging force of the urging member to move the printing medium holding hook from the close position to the open position.

21. The apparatus according to claim 20, wherein the open position lock mechanism includes an engaging member, the engaging member being mounted to the at least one of the two side surfaces of the rotary drum to make a pivotal movement between an engaging position in which the engaging member engages and locks the swing member which has driven the printing medium holding hook to the open position, and a disengaging position in which the engaging member disengages from and allows the swing member to be pivoted by the urging force of the urging member so as to move the printing medium holding hook from the open position to the close position, and the engaging member being urged toward the engaging position, the lock release mechanism includes a drive member and an actuator, the drive member being movable between a rest position in which the drive member is out of the trace of the engaging member of the open position lock mechanism when the rotary drum rotates with the engaging member being located at the engaging position, and an action position in which the drive member projects into the trace of the engaging member, and the actuator selectively moving the drive member between the rest position and the action position, the drive member being driven by the actuator to move from the rest position to the action position, striking the engaging member of the open position lock mechanism so that the engaging member moves from the engaging position to the disengaging position against the urging force applied thereto.

22. An ink jet printer employing the apparatus according to claim 16, comprising:

a printing medium feeding device which feeds the printing medium onto the outer surface of the rotary drum at a speed corresponding to a peripheral speed of the rotary drum; and at least one printing head disposed along the outer surface of the rotary drum to extend in parallel to the center line of rotation being supplied with an image signal, the at least one printing head having a plurality of ink jet nozzles provided to face the outer surface of the rotary drum and to align in parallel to the center line of rotation, and applying ink jets of at least one color to the printing medium to print an image according to the image signal on the printing medium while the rotary drum on which the printing medium is held conducts the specific number of rotations.

23. The ink jet printer according to claim 22, wherein a plurality of printing heads being mounted separate from each other along the outer surface of the rotary drum and being supplied with an image signal, each printing head extending in parallel to the center line of rotation and having a plurality of ink jet nozzles provided to face the outer surface of the rotary drum and to align in parallel to the center line of rotation, so that the printing heads apply ink jets of different colors to the printing medium to print a full color image according to the image signals on the printing medium while the rotary drum conducts the specific number of rotations.

24. The ink jet printer according to claim 22, further comprising a printing medium discharging device which conveys the printing medium removed from the outer surface of the rotary drum away from the rotary drum at least at a speed corresponding to the peripheral speed of the rotary drum.

25. An ink jet printer employing the apparatus according to claim 16, comprising:

a plurality of nozzle units corresponding to a plurality of ink colors arranged around the outer surface of the rotary drum along the rotation direction of the rotary drum, each nozzle unit having a plurality of ink jet nozzles arranged at equal intervals in a direction along the center line of rotation of the rotary drum; and an axially reciprocating mechanism which reciprocates the nozzle units in a direction along the center line of rotation of the rotary drum, the axially reciprocating mechanism moving the plurality of nozzle units by 1/N of an ink jet nozzle pitch PT at each rotation of the rotary drum and performing a color printing on the printing medium in a density that is N times in a density defined by the ink jet nozzle pitch PT, by using N times rotation of the rotary drum.

26. Apparatus for holding a printing medium on a rotary drum, comprising:

a rotary drum having a center line of rotation thereof and an outer surface arranged substantially concentric with the center line of rotation, the rotary drum rotating at a predetermined speed about the center line of rotation;

a printing medium suction device mounted to the rotary drum to hold the printing medium fed toward the outer surface of the rotary drum onto the outer surface of the rotary drum;

a printing medium holding mechanism having a printing medium holding hook, and being mounted to the rotary drum to selectively drive the printing medium holding hook between a close position and an open position, in the close position the printing medium holding hook being placed on the outer surface, and in open position the printing medium holding hook being spaced away from the outer surface, the printing medium holding hook in the open position being moved from the open position to the close position to securely hold a leading end of the printing medium fed toward the outer surface of the rotary drum with the outer surface of the rotary drum, the printing medium holding hook holding the leading end of the printing medium with the outer surface of the rotary drum, being returned from the close position to the open position when the rotary drum has conducted a specific number of rotations; and a printing medium removing mechanism which removes the printing medium from the outer surface of the rotary drum when the rotary drum has conducted the specific number of rotations and the printing medium holding hook of the printing medium holding mechanism has been moved from the close position to the open position, wherein the printing medium holding mechanism comprises:

a swing member mounted to at least one of two side surfaces of the rotary drum and supporting the printing medium holding hook to swing the printing medium holding hook between the close position and the open position;

an opening increasing mechanism mounted between the printing medium holding hook and the swing member and allowing the printing medium holding hook at the open position to project a rearward end of the printing medium holding hook, which is located opposite to the direction of rotation of the rotary drum, more outwardly in a radial direction of the rotary drum than a forward end of the printing medium holding hook in the direction of rotation of the rotary drum;

an urging member mounted to at least one of the two side surfaces of the rotary drum and urging the swing member to move the printing medium holding hook toward the close position;

a swing member holding device mounted to at least one of the two side surfaces of the rotary drum and selectively holding the swing member against an urging force of the urging member; and a printing medium holding hook operating device provided in relation to the at-least one of the two side surfaces of the rotary drum, just before the leading end of the printing medium fed toward the outer surface of the rotary drum is held between the printing medium holding hook of the printing medium holding mechanism and the outer surface of the rotary drum and just before the printing medium is removed by the printing medium removing mechanism from the outer surface of the rotary drum when the rotary drum on which the printing medium is held has conducted the specific number of rotations, the printing medium holding hook operating device operating the swing member to rotate the swing member in one direction against the urging force of the urging member so that the printing medium holding hook is moved by the swing member via an intermediate member between the close position and the open position and simultaneously making the swing member holding device hold the swing member when the swing member is not held by the swing member holding device, and the printing medium holding hook operating device operating the swing member holding device to release the holding of the swing member so that the swing member is allowed to rotate in the other direction by the urging force of the urging member and the printing medium holding hook is moved by the swing member via the intermediate member between the close position and the open position when the swing member is held by the swing member holding device.

27. The apparatus according to claim 26, wherein the opening increasing mechanism includes the urging member mounted between the printing medium holding hook and the swing member and urging the printing medium holding hook so that the rearward end of the printing medium holding hook, which is located opposite to the direction of rotation of the rotary drum, is projected radially more outwardly than the forward end of the printing medium holding hook in the direction of rotation of the rotary drum.

28. The apparatus according to claim 26, wherein the printing medium holding hook operating device comprises:

a sub swing member mounted to the at least one of the two side surfaces of the rotary drum so as to be pivotable in response to the pivotal movement of the swing member;

a drive member being movable between a rest position in which the drive member is out of the trace of the sub swing member of the printing medium holding mechanism when the rotary drum rotates with the printing medium holding hook being located at the close position, and an action position in which the drive member projects into the trace; and an actuator selectively moving the drive member between the rest position and the action position, and the drive member selectively driven by the actuator to move from the rest position to the action position, striking the sub swing member so that the sub swing member drives the swing member against the urging force of the urging member to move the printing medium holding hook between the close position and the open position by the swing member.

29. An ink jet printer employing the apparatus according to claim 28, further comprising:

a printing medium feeding device which feeds the printing medium onto the outer surface of the rotary drum at a speed corresponding to a peripheral speed of the rotary drum; and at least one printing head disposed along the outer surface of the rotary drum to extend in parallel with the center line of rotation, is supplied with an image signal, has a plurality of ink jet nozzles provided to face the outer surface of the rotary drum and to align in parallel with the center line of rotation, and applies ink jets of at least one color to the printing medium to print an image according to the image signal on the printing medium while the rotary drum on which the printing medium is held conducts the specific number of rotations.

30. An ink jet printer according to claim 29, wherein a plurality of the printing heads are mounted separate from each other along the outer surface of the rotary drum and are supplied with image signals, each printing head extending in parallel to the center line of rotation and having a plurality of ink jet nozzles provided to face the outer surface of the rotary drum and to align in parallel to the center line of rotation, so that the printing heads apply ink jets of different colors to the printing medium to print a full color image according to the image signals on the printing medium while the rotary drum conducts the specific number of rotations.

31. An ink jet printer according to claim 29, further comprising a printing medium discharging device which conveys the printing medium removed from the outer surface of the rotary drum, away from the rotary drum at least at a speed corresponding to the peripheral speed of the rotary drum.

32. The apparatus according to claim 26, wherein the swing member holding device comprises:

an engaging member supported by at least one of the two side surfaces of the rotary drum to be pivotable between an engaging position, in which the engaging member engages and locks the swing member which has been rotated in one direction against the urging force of the urging member, and a disengaging position, in which the engaging member releases its engagement with and allows the swing member to rotate in the other direction by the urging force of the urging member, the engaging member being urged towards the engaging position, wherein the printing medium holding hook operating device comprises:

a drive member being movable between a rest position, in which the drive member is out of a trace of the engaging member during the rotation of the rotary drum, and an action position, in which the drive member is projected into the trace of the engaging member; and an actuator selectively moving the drive member between the rest position and the action position, wherein the drive member selectively moved from the rest position to the action position by the actuator strikes the engaging member located in the engaging position, so that the drive member moves the engaging member from the engaging position to the disengaging position against the urging force applied thereto.

33. An ink jet printer employing the apparatus according to claim 26, further comprising:

a printing medium feeding device which feeds the printing medium onto the outer surface of the rotary drum at a speed corresponding to a peripheral speed of the rotary drum; and at least one printing head disposed along the outer surface of the rotary drum to extend in parallel to the center line of rotation and being supplied with an image signal, the at least one printing head having a plurality of ink jet nozzles provided to face the outer surface of the rotary drum and to align in parallel with the center line of rotation, and applying ink jets of at least one color to the printing medium to print an image according to the image signal on the printing medium on the rotary drum while the rotary drum conducts the specific number of rotations.

34. The ink jet printer according to claim 33, wherein a plurality of printing heads are mounted separate from each other along the outer surface of the rotary drum and are supplied with image signals, each printing head extending in parallel with the center line of rotation and having a plurality of ink jet nozzles provided to face the outer surface of the rotary drum and to align in parallel with the center line of rotation, so that the printing heads apply ink jets of different colors to the printing medium to print a full color image according to the image signals on the printing medium while the rotary drum conducts the specific number of rotations.

35. The ink jet printer according to claim 33, further comprising a printing medium discharging device which conveys the printing medium removed from the outer surface of the rotary drum, away from the rotary drum at least at a speed corresponding to the peripheral speed of the rotary drum.

36. An ink jet printer employing the apparatus according to claim 26, comprising:

a plurality of nozzle units corresponding to a plurality of ink colors arranged around the outer surface of the rotary drum along the rotation direction of the rotary drum, each nozzle unit having a plurality of ink jet nozzles arranged at equal intervals in a direction along the center line of rotation of the rotary drum; and an axially reciprocating mechanism which reciprocates the nozzle units in a direction along the center line of rotation of the rotary drum, the axially reciprocating mechanism moving the plurality of nozzle units by 1/N of an ink jet nozzle pitch PT at each rotation of the rotary drum and performing a color printing on the printing medium in a density that is N times in a density defined by the ink jet nozzle pitch PT, by using N times rotation of the rotary drum.

37. An apparatus for holding a printing medium on a rotary drum, comprising:

a rotary drum having a center line of rotation thereof and an outer surface arranged substantially concentric with the center line of rotation, the rotary drum rotating at a predetermined speed about the center line of rotation;

a printing medium suction device mounted to the rotary drum to hold the printing medium fed toward the outer surface of the rotary drum onto the outer surface of the rotary drum;

a printing medium holding mechanism having a printing medium holding hook, and being mounted to the rotary drum to selectively drive the printing medium holding hook between a close position and an open position, in the close position the printing medium holding hook being placed on the outer surface, and in the open position the printing medium holding hook being spaced away from the outer surface, the printing medium holding hook in the open position being moved from the open position to the close position to securely hold a leading end of the printing medium fed toward the outer surface of the rotary drum with the outer surface of the rotary drum, and the printing medium holding hook holding the leading end of the printing medium with outer surface of the rotary drum, being returned from the close position to the open position when the rotary drum has conducted a specific number of rotations; and a printing medium removing mechanism which removes the printing medium from the outer surface of the rotary drum when the rotary drum has conducted the specific number of rotations and the printing medium holding hook of the printing medium holding mechanism has been moved from the close position to the open position, wherein the printing medium holding mechanism comprises:

a swing member swingably mounted to at least one of two side surfaces of the rotary drum;

an intermediate member swingably mounted to the swing member, swingably supporting the printing medium holding hook at a location which is more outward from a location at which the intermediate member is mounted to the swing member in a radial direction of the rotary drum, and moving the printing medium holding hook between the close position and the open position by a swing movement of the swing member;

an opening increasing mechanism mounted between the printing medium holding hook and the intermediate member and allowing the printing medium holding hook at the open position to project a rearward end of the holding hook, which is located opposite the direction of rotation of the rotary drum, more outwardly in a radial direction of the rotary drum than a forward end of the holding hook in the direction of rotation of the rotary drum;

an urging member mounted to at least one of the two side surfaces of the rotary drum and urging the swing member in a predetermined direction;

a swing member holding device mounted to at least one of the two side surfaces of the rotary drum and selectively holding the swing member against an urging force of the urging member; and a printing medium holding hook operating device provided in relation to the at least one of the two side surfaces of the rotary drum, just before the leading end of the printing medium fed toward the outer surface of the rotary drum is held between the printing medium holding hook of the printing medium holding mechanism and the outer surface of the rotary drum and just before the printing medium is removed by the printing medium removing mechanism from the outer surface of the rotary drum when the rotary drum on which the printing medium is held has conducted the specific number of rotations, the printing medium holding hook operating device operating the swing member holding device to release the holding of the swing member so that the swing member is allowed to rotate in one direction by the urging force of the urging member, the printing medium holding hook is moved by the swing member via the intermediate member between the close position and the open position when the swing member is held by the swing member holding device, and the printing medium holding hook operating device operating the swing member to rotate the swing member in the other direction against the urging force of the urging member so that the printing medium holding hook is moved by the swing member via the intermediate member between the close position and the open position and simultaneously making the swing member holding device hold the swing member when the swing member is not held by the swing member holding device.

38. The apparatus according to claim 37, wherein the opening increasing mechanism includes an urging member mounted between the printing medium holding hook and the intermediate member and urging the printing medium holding hook so that the rearward end of the printing medium holding hook, which is located opposite to the direction of rotation of the rotary drum, is projected radially more outwardly than the forward end of the printing medium holding hook in the direction of rotation of the rotary drum.

39. The apparatus according to claim 37, wherein the printing medium holding hook operating device comprises:

a sub swing member mounted to at least one of the two side surfaces of the rotary drum so as to be pivotable in response to the pivotal movement of the swing member;

a drive member being movable between a rest position in which the drive member is out of the trace of the sub swing member when the rotary drum rotates with the printing medium holding hook being located at the close position, and an action position in which the drive member projects into the trace; and an actuator selectively moving the drive member between the rest position and the action position, and the drive member selectively driven by the actuator to move from the rest position to the action position strikes the sub swing member so that the sub swing member drives the swing member against the urging force of the urging member to move the printing medium holding hook between the close position and the open position by the swing member.

40. The apparatus according to claim 37, wherein the swing member holding device comprises:

an engaging member supported by at least one of the two side surfaces of the rotary drum to be pivotable between an engaging position, in which the engaging member engages and locks the swing member which has been rotated in one direction against the urging force of the urging member, and a disengaging position, in which the engaging member releases its engagement with and allows the swing member to rotate in the other direction by the urging force of the urging member, the engaging member being urged towards the engaging position, wherein the printing medium holding hook operating device comprises:

a drive member being movable between a rest position, in which the drive member is out of a trace of the engaging member during the rotation of the rotary drum, and an action position, in which the drive member is projected into the trace of the engaging member; and an actuator selectively moving the drive member between the rest position and the action position, wherein the drive member selectively moved from the rest position to the action position by the actuator strikes the engaging member located in the engaging position, so that the drive member moves the engaging member from the engaging position to the disengaging position against the urging force applied thereto.

41. An ink jet printer employing the apparatus according to claim 37, comprising:

a plurality of nozzle units corresponding to a plurality of ink colors, arranged around the outer surface of the rotary drum along the rotation direction of the rotary drum, each nozzle unit having a plurality of ink jet nozzles arranged at equal intervals in a direction along the center line of rotation of the rotary drum; and an axially reciprocating mechanism which reciprocates the nozzle units in a direction along the center line of rotation of the rotary drum, the axially reciprocating mechanism moving the plurality of nozzle units by 1/N of an ink jet nozzle pitch PT at each rotation of the rotary drum and being able to perform a color printing on the printing medium in a density that is N times in a density defined by the ink jet nozzle pitch PT, by using N times rotation of the rotary drum.

* * * * *